US007077118B2

(12) United States Patent
Lewis

(10) Patent No.: US 7,077,118 B2
(45) Date of Patent: Jul. 18, 2006

(54) PAINTBALL GUN RELOADING SYSTEM

(76) Inventor: Robert Lewis, 4780 W. River Dr., NE., Comstock Park, MI (US) 49321

( * ) Notice: Subject to any disclaimer, the term of this patent is extended or adjusted under 35 U.S.C. 154(b) by 0 days.

(21) Appl. No.: 10/708,888

(22) Filed: Mar. 30, 2004

(65) Prior Publication Data

US 2005/0028801 A1 Feb. 10, 2005

Related U.S. Application Data

(60) Provisional application No. 60/481,182, filed on Aug. 6, 2003.

(51) Int. Cl.
*F41B 11/02* (2006.01)

(52) U.S. Cl. ..... 124/45; 124/49

(58) Field of Classification Search ..... 124/45, 124/49

See application file for complete search history.

(56) References Cited

U.S. PATENT DOCUMENTS 3,263,664 A 8/1966 Bauer et al.
5,511,333 A * 4/1996 Farrell ..... 42/49.01
5,809,983 A 9/1998 Stoneking
6,015,058 A 1/2000 Parks
6,055,975 A 5/2000 Gallagher et al.
6,234,157 B1 5/2001 Parks
6,273,079 B1 * 8/2001 Jzn ..... 124/49
6,481,432 B1 11/2002 Rushton et al.
6,508,384 B1 1/2003 Tien et al.
6,722,355 B1 * 4/2004 Andrews, Jr. ..... 124/49

* cited by examiner

*Primary Examiner*—John A. Ricci
(74) *Attorney, Agent, or Firm*—McGarry Bair PC

(57) ABSTRACT

A paintball gun reloading system comprises a cylindrical shaped canister having a gate at an open end, which can be spring-biased to a closed position. A port cover closing a filling port in a paintball gun storage reservoir comprises a hands-free openable cover which is adapted to open when the reloading canister is inserted into the filling port, and to close when the canister is removed from the filling port. The gate is opened as the canister is inserted into the filling port, and is reclosable as the canister is removed from the filling port.

37 Claims, 33 Drawing Sheets

PAINTBALL GUN RELOADING SYSTEM

CROSS-REFERENCE TO RELATED APPLICATION

This application claims the benefit of U.S. provisional application Ser. No. 60/481,182, filed Aug. 6, 2003, which is incorporated herein in its entirety.

FIELD OF THE INVENTION

This invention relates to reloading devices for paintball gun magazines and more particularly to a reloading device which can be operated with one hand.

DESCRIPTION OF THE RELATED ART

Games involving the use of paintball guns are increasingly popular. The paintball gun is used by a participant to propel a paintball against a target, typically another participant, who will similarly use a paintball gun to attempt to hit other participants, and so on. If a participant is struck or "shot," as evidenced by the paint marker left by the paintball, he or she becomes a "casualty," and is out of the game. Several teams comprising a large number of participants may be involved in a single "battle" conducted over a large indoor or outdoor area.

A typical paintball gun comprises a magazine of sufficient size to hold a relatively large quantity of paintballs. However, it is frequently necessary to refill the magazine during the course of a game. If the game involves a large number of participants, it may be necessary to refill the magazine several times during the course of the game. Refilling typically occurs while the participant is in the midst of intense action, with other participants attempting to take advantage of the participant's reduced ability to defend himself or herself during the refilling process, and score a hit on the participant. Thus, it is advantageous to complete a refilling operation as quickly and effectively as possible.

Each participant will carry a large quantity of paintballs for refilling of the magazine during the game. These paintballs are typically carried in containers having covers that can be attached to prevent the paintballs from spilling during the game, but can be opened and used to fill the magazine. However, such containers typically require two hands to open the container and refill the magazine. During the refilling process, the participant's attention is diverted from the game, the participant is unable to fire his or her paintball gun, and the participant cannot readily move about in order to avoid being hit by an opponent's paintball.

Paintball magazines typically comprise a loading port which is closed by a cover. The cover may be attached to the loading port as a threaded connection, or, more typically, as a spring-biased flapped cover that can be easily flipped open, and will self close under the action of the spring. Refilling thus requires that the participant select a refill container, open the container cover, open the magazine cover, introduce the paintballs from the refill container into the magazine while holding the container and the magazine covers open, and finally reclose the magazine cover and resume the game. During this operation, which may take up to a minute to complete, the participant is exposed to the other participants' attempts to shoot him or her.

Contemporary attempts to improve the paintball refilling process involve a cylindrical canister that utilizes a sliding ring attached to a plurality of gates that open as the ring is translated along the canister, and a basket-shaped retainer that opens when the canister engages the retainer. However, if the ring fails to slide as intended, the canister will be unable to open in order to empty its contents, or to close in order to prevent the loss of its contents. Moreover, the basket elements can break or fail, thus allowing paintballs to spill from the magazine.

SUMMARY OF THE INVENTION

A paintball gun reloading assembly for use by a participant in a paintball competition to supply paintballs to a paintball storage reservoir having a filling opening therein, the paintball gun reloading assembly comprises a cover assembly attached to the paintball storage reservoir comprising a cover movable from a closed position to prevent paintballs from spilling from the storage reservoir to an open position for receiving paintballs into the storage reservoir, a reloading canister having a discharge opening adapted for at least partial insertion into the filling opening and comprising a gate assembly having at least one gate pivotable from a closed position closing the discharge opening to an open position away from the discharge opening, and at least one pivot boss attached to the at least one gate for moving the at least one gate from the closed position to the open position when the at least one pivot boss is in contact with the cover assembly and the reloading canister is moved into the filling opening, wherein the cover and the at least one gate are movable to the open position by the engagement of the reloading canister with the cover assembly, and wherein the participant can continuously operate the paintball gun during the filling process.

The cover assembly can comprise a hinged cover pivotable between the closed and open positions. The hinged cover can further comprise a flange portion for engaging the at least one pivot boss to open the hinged cover, and a latch pin attached to the at least one pivot boss and movable between an extended position and a retracted position.

The cover assembly can comprise a tongue piece for directing the discharge opening to the hinged cover or the filling opening, or directing the pivot boss to the flange portion.

The paintball gun reloading assembly can further comprise a biasing mechanism, such as a spring, for urging the cover to the closed position. The cover assembly can comprise at least one membrane stretched across the filling opening and deformable from the closed position to the open position. The at least one membrane can comprise a pair of semicircular membranes separated by a slit.

The gate assembly can comprise at least two radially-opposed, spoon-shaped gates, an elliptical gate, a circular gate, or a planar gate. The at least one pivot boss can be attached to the at least two radially-opposed, spoon-shaped gates, or the at least one gate.

The paintball gun reloading assembly can further comprise a biasing mechanism, such as a spring, for urging the at least one gate to the closed position.

In another embodiment, a combination paintball gun, paintball storage reservoir, and paintball gun reloading assembly comprises a paintball gun for use by a participant in a paintball competition for firing paintballs at a target, a paintball storage reservoir having a filling opening therein and attached to the paintball gun for supplying paintballs to the paintball gun, a cover assembly attached to the paintball storage reservoir comprising a cover movable from a closed position to prevent paintballs from spilling from the storage reservoir to an open position for receiving paintballs into the storage reservoir, a reloading canister having a discharge opening adapted for at least partial insertion into the filling opening and comprising a gate assembly having at least one gate pivotable from a closed position closing the discharge opening to an open position away from the discharge opening, and a pivot boss for moving the at least one gate from the closed position to the open position when the pivot boss is in contact with the cover assembly and the reloading canister is moved relative to the filling opening, wherein the cover and the at least one gate are movable to the open position by the engagement of the reloading canister with the cover assembly, and wherein the participant can continuously operate the paintball gun during the filling process.

In another embodiment, a method for supplying paintballs to a paintball storage reservoir having a filling opening therein comprises attaching a cover assembly to the paintball storage reservoir, the cover assembly comprising a cover adjustable from a closed position to prevent paintballs from spilling from the storage reservoir to an open position for receiving paintballs into the storage reservoir, engaging a reloading canister with the filling opening, the reloading canister having a discharge opening and comprising a gate assembly having at least one gate moveable from a closed position closing the discharge opening to an open position away from the discharge opening, moving the reloading canister toward the filling opening so that the cover moves from the closed position to the open position, moving the reloading canister toward the filling opening so that at least one pivot boss extending from the at least one gate is in contact with the cover assembly, moving the at least one gate from the closed position to the open position by moving the reloading canister relative to the filling opening, and discharging paintballs through the discharge opening into the filling opening to fill the storage reservoir, using one hand to open the cover assembly, move the reloading canister into the filling opening, and open the gate assembly to discharge paintballs into the storage reservoir while supporting the storage reservoir with the other hand.

The method can further comprise moving the reloading canister toward the filling opening along a tongue piece, and moving the reloading canister away from the filling opening to move the cover from the open position to the closed position The method can further comprise moving the reloading canister away from the filling opening to move the at least one gate from the open position to the closed position, pivoting the at least one gate from the closed position to the open position, and latching the at least one gate in the closed position with a movable latch pin.

DESCRIPTION OF EMBODIMENTS OF THE INVENTION

The description which follows describes several embodiments of a paintball gun reloading canister for loading paintballs into a paintball gun. The embodiments share some common elements and, thus, like elements will be identified with like numerals. It should also be noted that the paintball gun reloading canister described herein can be adapted for use with different paintball gun hoppers. Thus, the embodiments described herein should be considered exemplary only and not limiting, except where otherwise indicated.

Figure 1:
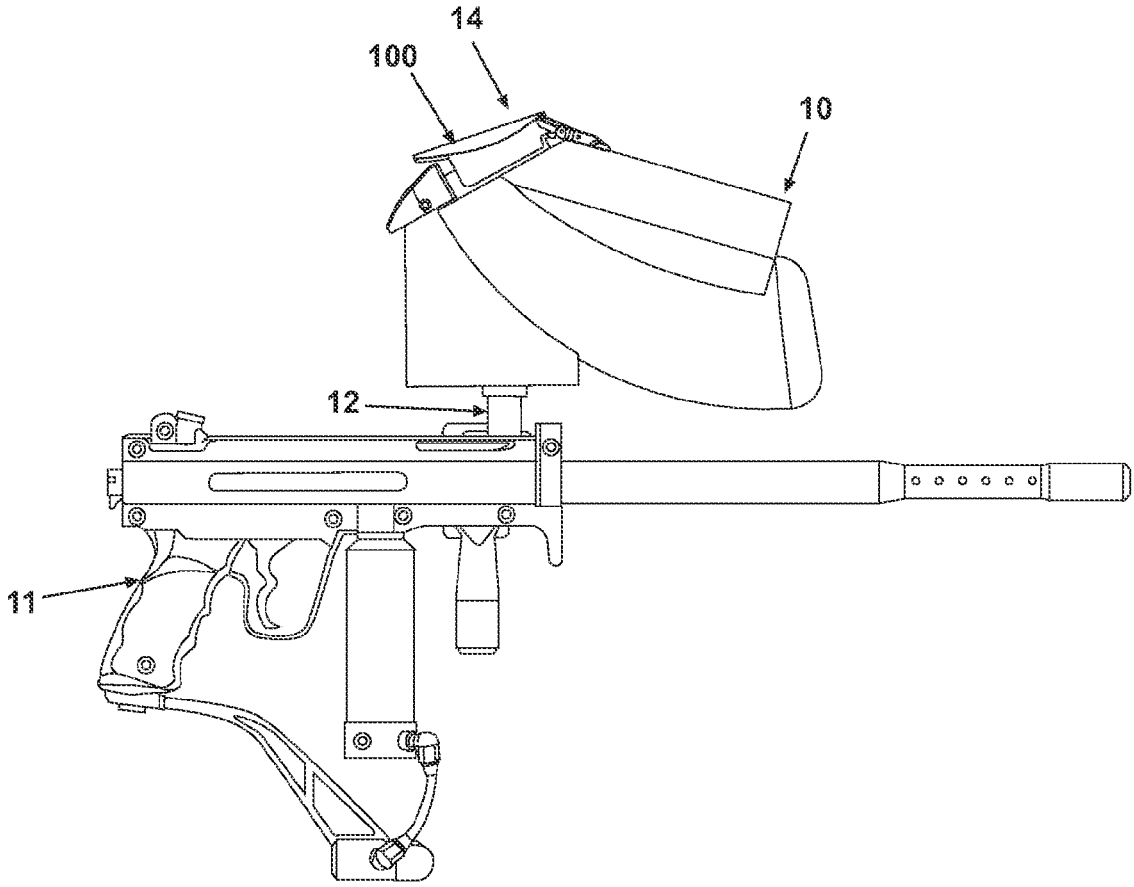
FIG. 1 is a perspective view of a paintball gun attached to a paintball gun storage reservoir provided with a first embodiment of a filling port cover assembly according to the invention.

FIG. 1 illustrates a paintball storage reservoir 10, also known as a loader or hopper, which is attached to a conventional paintball gun 11 and supplies paintballs one at a time to the gun 11 through a discharge port 12. The invention will be described hereinafter with respect to a VL Revolution TM loader manufactured and marketed by Viewloader of Bentonville, Ark., although the invention can be adapted for use with other loaders, as will become evident to a person of ordinary skill in the art. The paintball storage reservoir 10 is filled with paintballs through a filling port 14, which, in the prior art, is typically closed with a flip-top or threaded cover (not shown). In the embodiment illustrated in FIG. 1, the conventional cover has been replaced by a cover assembly 100 according to the invention, as hereinafter described.

Figure 2:
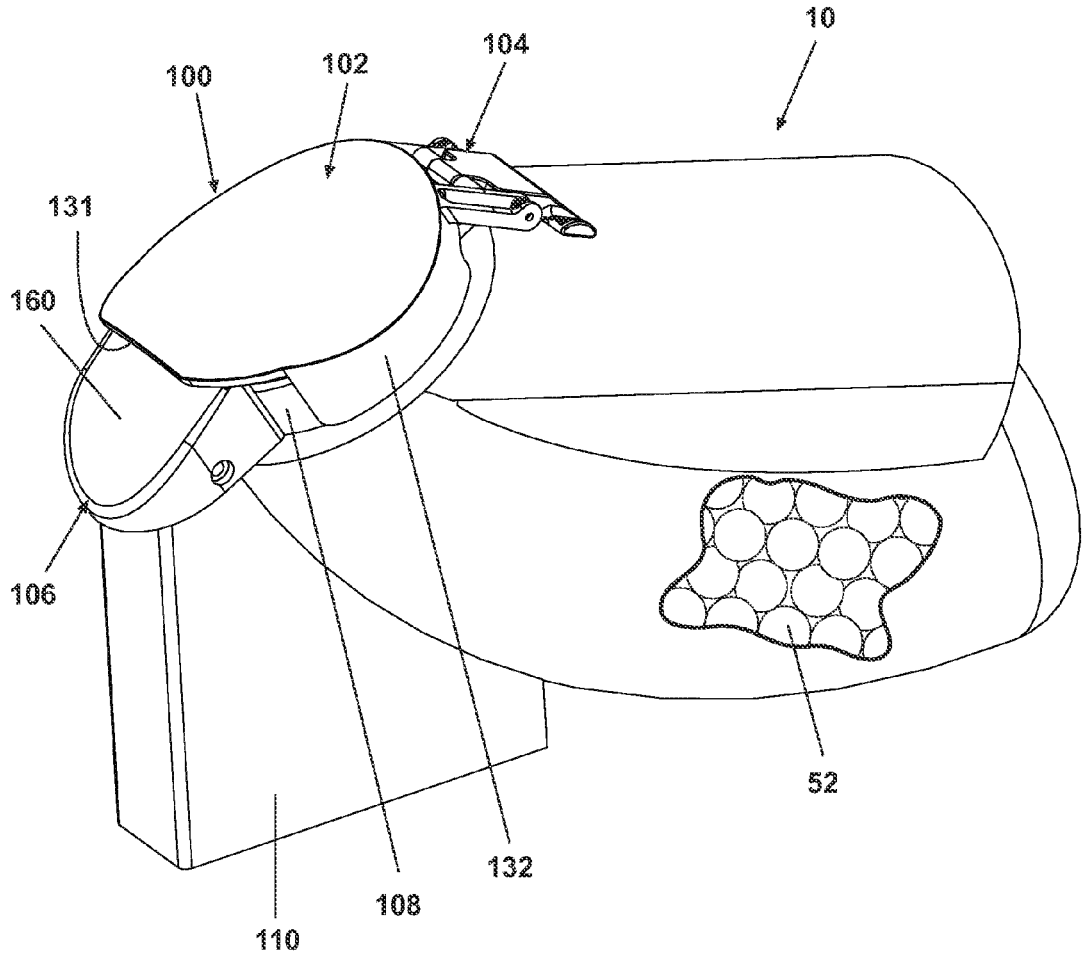
FIG. 2 is a perspective view of the paintball gun storage reservoir illustrated in FIG. 1 with the filling port cover assembly in a closed position.
Figure 3:
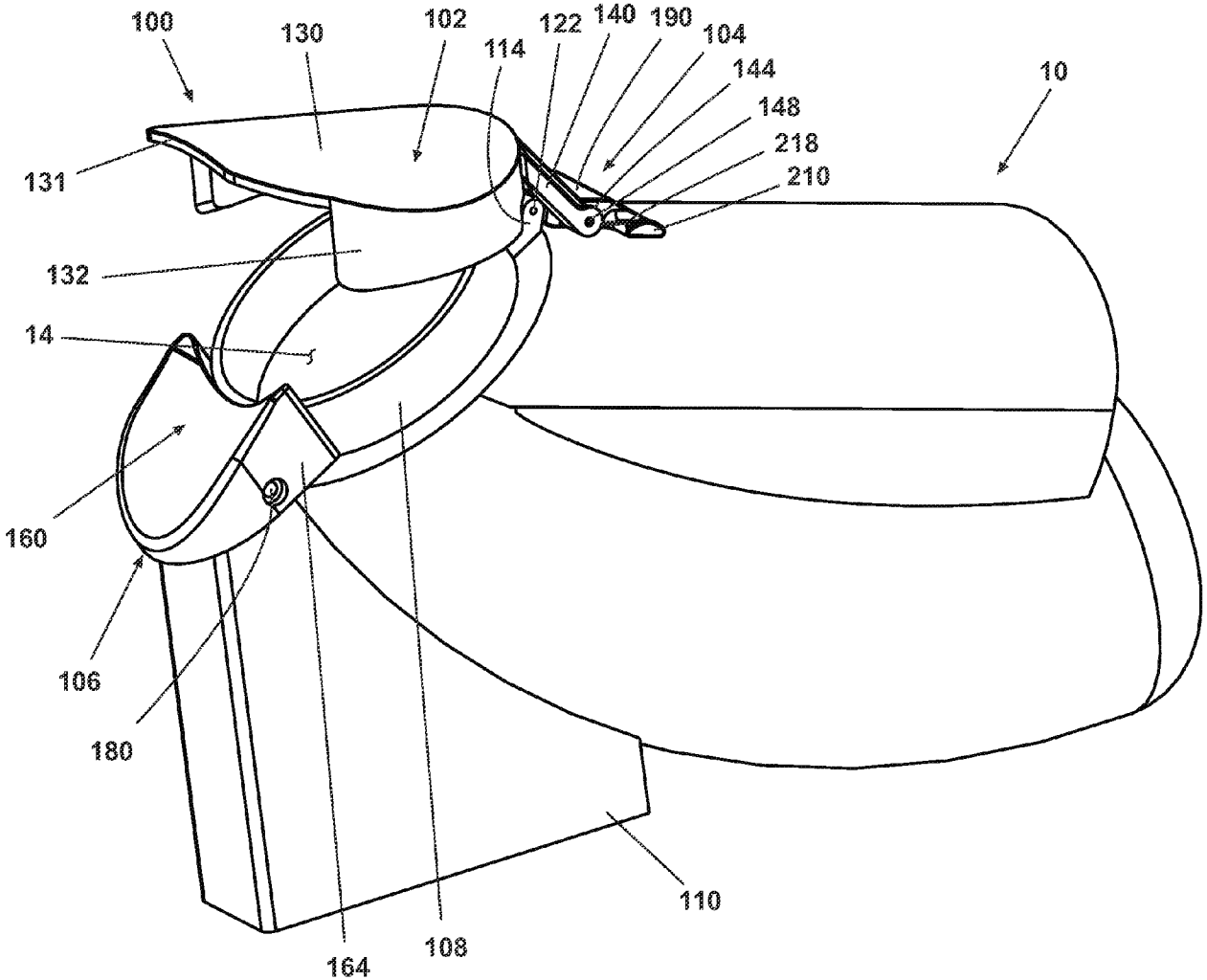
FIG. 3 is a perspective view of the paintball gun storage reservoir illustrated in FIG. 2 with the filling port cover assembly in an open position.

FIGS. 2 and 3 illustrate a prior art storage reservoir 10 retrofitted with the cover assembly 100, and adapted to hold a plurality of paintballs 52. The storage reservoir 10 is provided with a reservoir buttress 110 which encloses a power supply, mechanical components for feeding the paintballs 52 to the discharge port 12, and the like. The reservoir buttress 110 is provided with a fastener aperture 112 adjacent to the filling port 14. The filling port 14 is circumscribed by an annular filling port wall 108 which is adapted for operable communication with a cover.

Diametrically opposite the reservoir buttress 110, the filling port wall 108 transitions to a pair of elongated cover attachment arms 114, 116 in spaced-apart, parallel juxtaposition terminating in an enlarged bearing end 118, 120. Each bearing end 118, 120 is provided with a pin aperture 122, 124 therethrough in coaxial relationship with the other for hingedly attaching the cover over the filling port 14.

Figure 4:
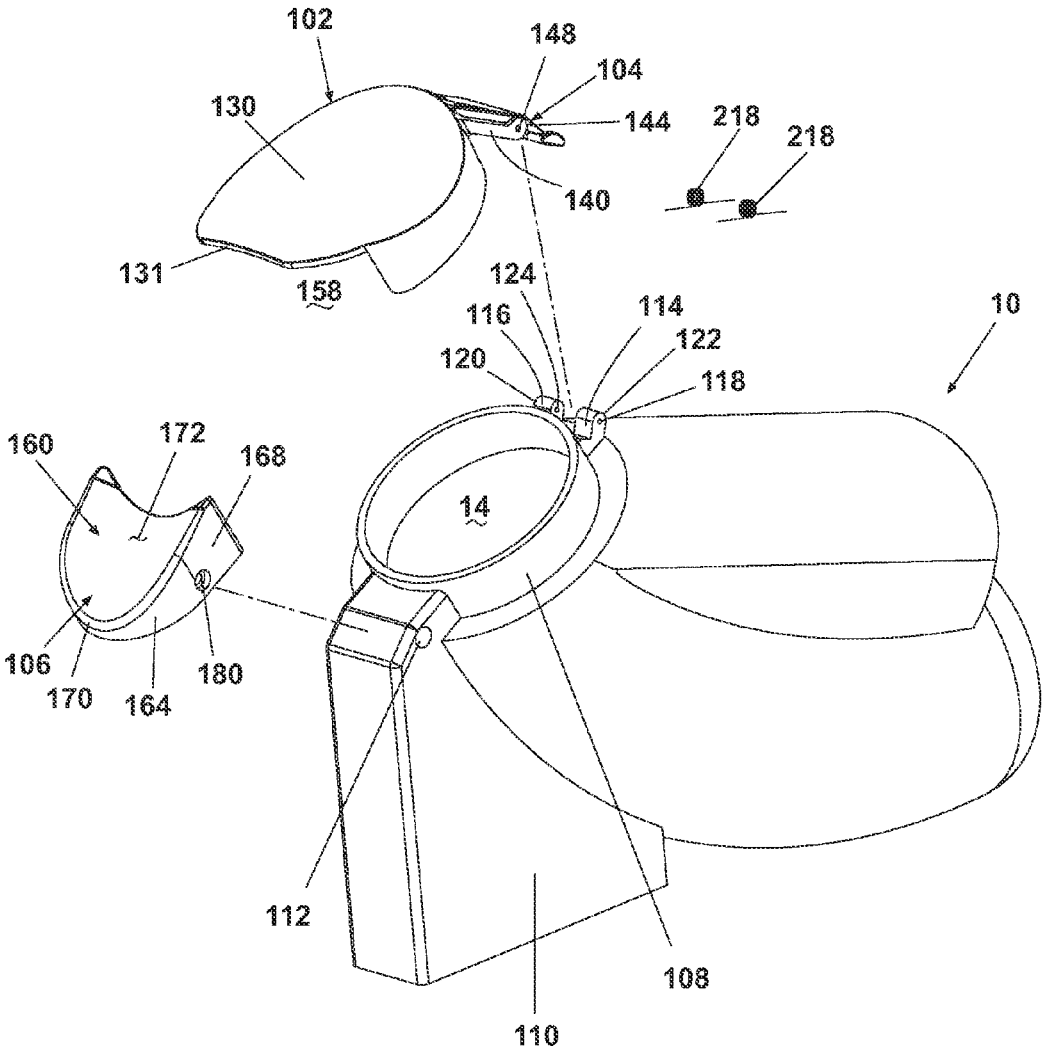
FIG. 4 is a partial exploded view of the paintball gun storage reservoir illustrated in FIG. 2.
Figure 5A:
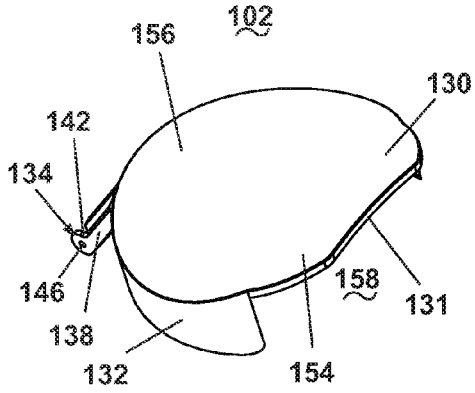
FIGS. 5A–F are perspective, plan, and elevation views of a port cover comprising a portion of the filling port cover assembly illustrated in FIG. 4.
Figure 5B:
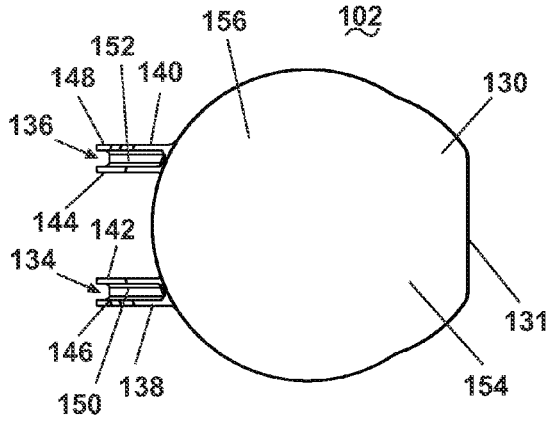
Figure 5C:
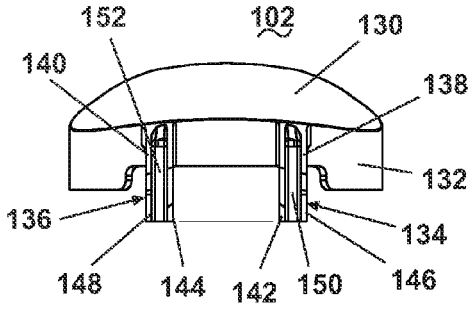
Figure 5D:
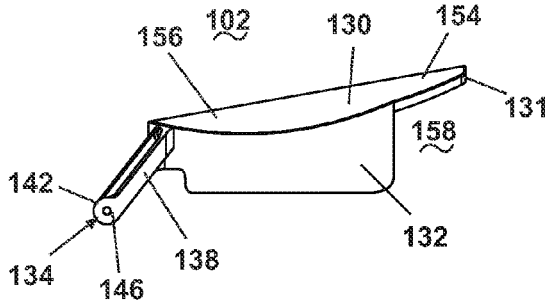
Figure 5E:
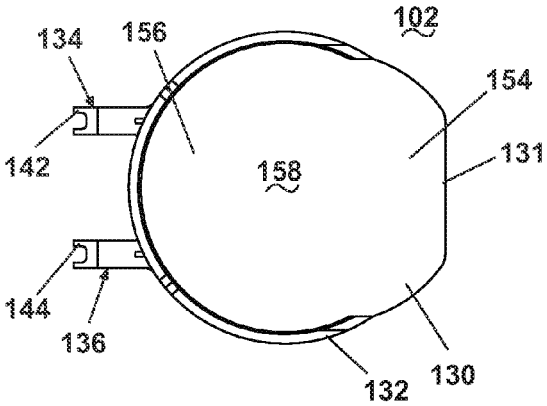
Figure 5F:
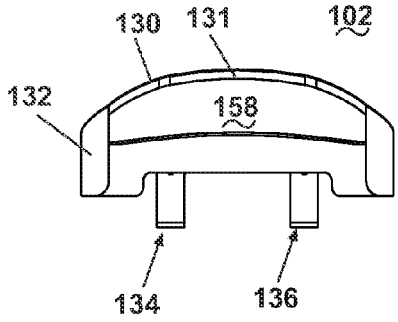

The cover assembly 100 comprises a self-closing port cover 102, a hinge assembly 104, and a tongue piece 106. Referring now to FIGS. 4 and 5, the port cover 102 comprises a top wall 130 having a circular central portion 156 transitioning along a first side to a flange portion 154. The flange portion 154 terminates along a side away from the central portion 156 in a straight edge 131 which is parallel to a tangent to the central portion 156. As illustrated in FIGS. 5C, 5D, and 5F, in section the port cover 102 has an arcuate shape.

Extending downwardly from and around the central portion 156 is a semiannular wall 132 terminating at both ends at the intersection of the central portion 156 and the flange portion 154, thereby defining a gap 158 in the wall 132 corresponding generally to the width of the flange portion 154. The wall 132 is adapted for slidable register with the outer circumference of the filling port wall 108.

Diametrically opposite the flange portion 154 and extending downwardly away from the wall 132 are a pair of hinge arms 134, 136 in parallel, spaced-apart juxtaposition. Each arm 134, 136 comprises an elongated beam portion 138, 140 defining a channelway 150, 152 and terminating in an enlarged distal end 142, 144. Each distal end 142, 144 is provided with a pin aperture 146, 148 extending therethrough in coaxial relationship with the other for hingedly attaching the cover over the filling port 14.

Figure 6A:
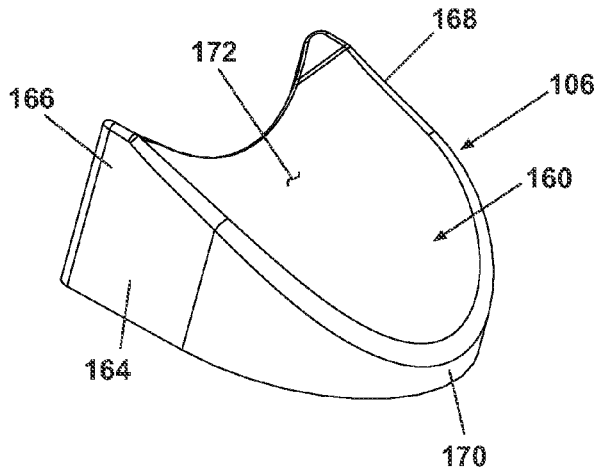
FIGS. 6A–C are perspective views of a tongue piece comprising a portion of the filling port cover assembly illustrated in FIG. 4.
Figure 6B:
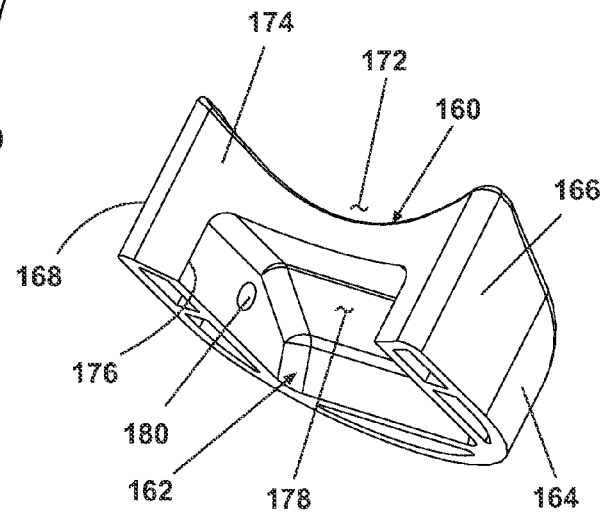
Figure 6C:
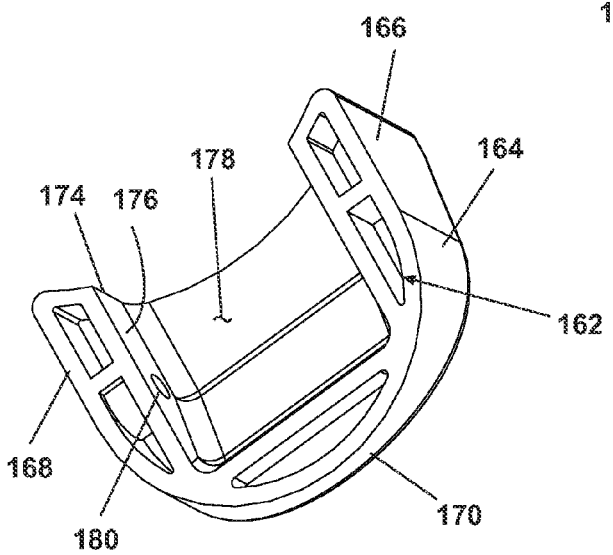

Referring now to FIGS. 4 and 6, the tongue piece 106 is a somewhat arcuate, wedge-shaped body having an upper side 160 and a lower side 162 separated by an arcuate perimeter wall 164 and a planar back wall 174. The perimeter wall 164 defines a pair of side portions 166, 168 adjacent the back wall 174. In section, the upper side 160 has an arcuate shape defining a longitudinal trough 172 bounded by the perimeter wall 164. The trough 172 and the perimeter wall 164 meet at a proximal portion, which defines an apex 170.

The lower side 162 is provided with a slot-like opening 176 to define a receptacle 178 adapted for slidable register with the reservoir buttress 110. A pin aperture 180 extends through a side portion 168 for coaxial alignment with the fastener aperture 112 when the tongue piece 106 is slidably received over an upper portion of the reservoir buttress 110, as shown in FIG. 3.

Figure 7A:
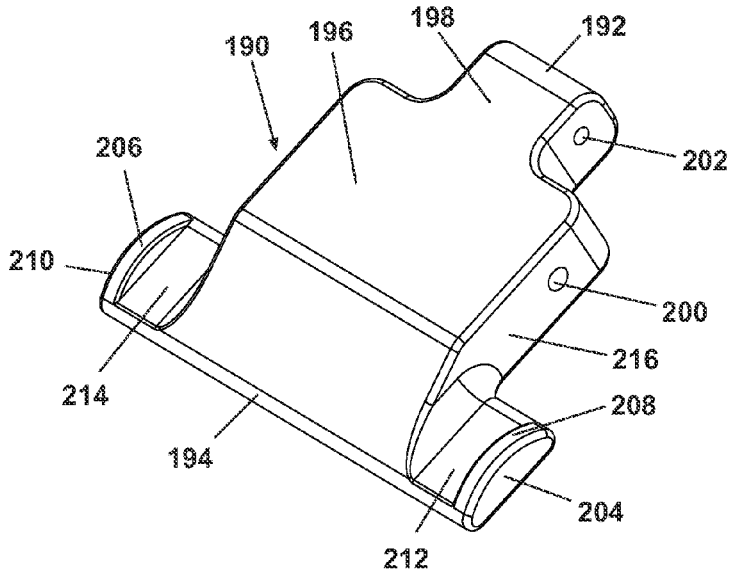
FIGS. 7A–C are perspective, plan, and elevation views of a hinge block comprising a portion of the filling port cover assembly illustrated in FIG. 4.
Figure 7B:
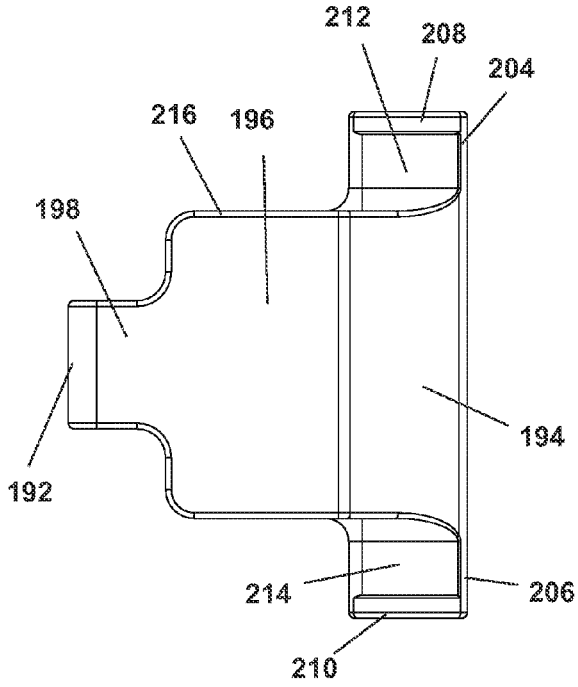
Figure 7C:
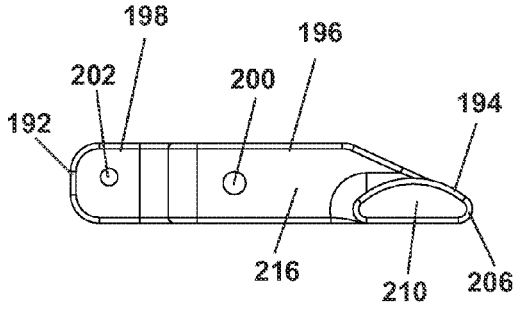
Figure 8:
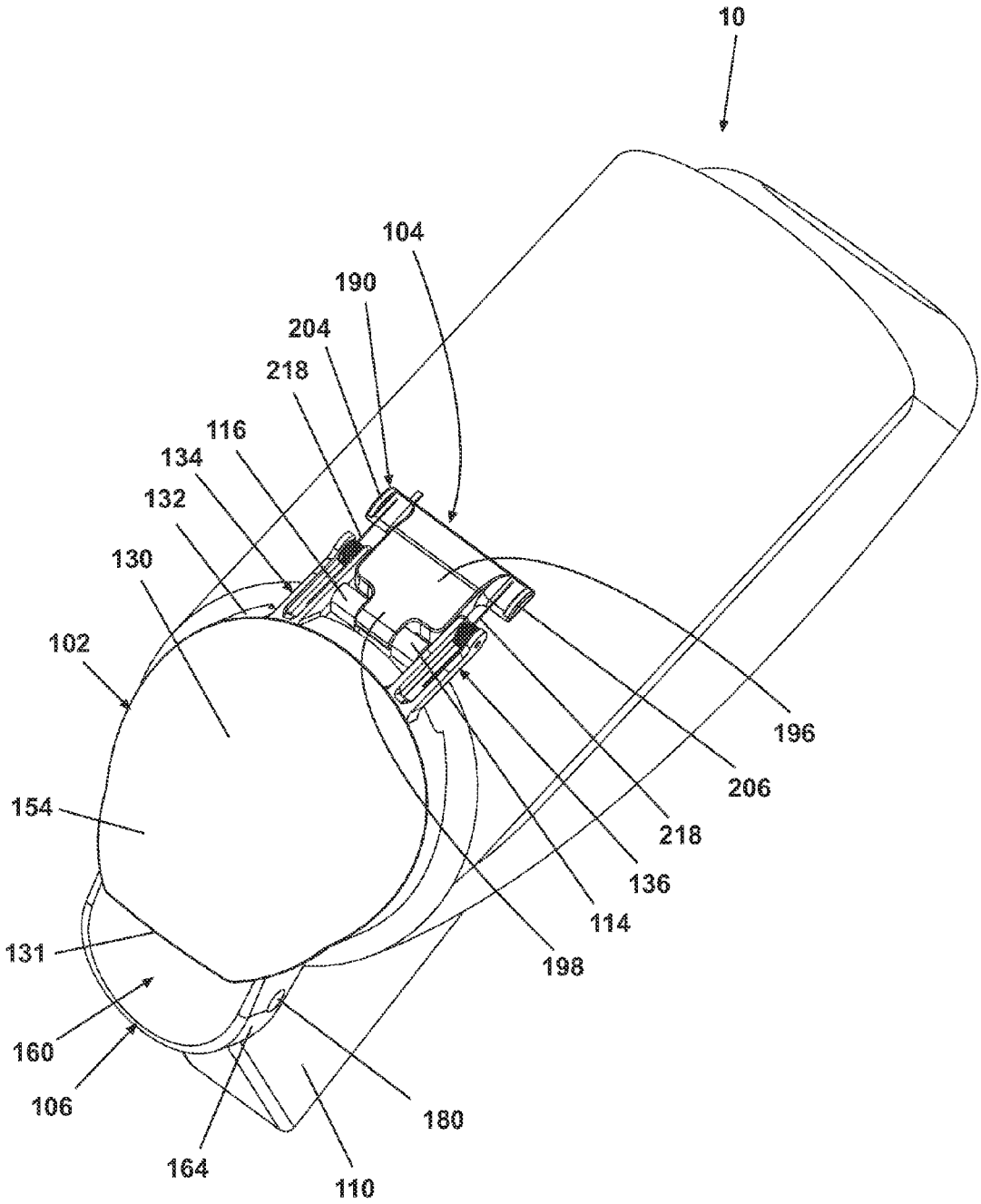
FIG. 8 is a perspective view from above of the paintball gun storage reservoir illustrated in FIG. 2 with the filling port cover assembly in a closed position.

Referring now to FIGS. 3, 7, and 8, a hinge block 190 comprises an irregularly-shaped body having a hinge end 192 and a flange end 194. The hinge end 192 comprises a hinge support 198 adapted for slidable register with the cover attachment arms 114, 116. The hinge support 198 is provided with a reservoir aperture 202 extending therethrough and adapted for coaxial alignment with the pin apertures 122, 124 when the hinge support 198 is inserted between the cover attachment arms 114, 116.

The hinge support 198 transitions to a center block 196 having a somewhat greater width than the hinge support 198, and adapted for slidable register with the hinge arms 134, 136. The center block 196 is provided with a cover aperture 200 extending therethrough and adapted for coaxial alignment with the pin apertures 146, 148 when the center block 196 is inserted between the hinge arms 134, 136.

The center block 196 transitions through a somewhat wedge-shaped portion to the flange end 194. The flange end 194 comprises a pair of laterally-spaced flanges 204, 206, each having an upwardly-extending flange wall 208, 210 to form a channel 212, 214 intermediate the flange wall 208, 210 and the center block 196.

Referring again to the Figures, and in particular to FIG. 8, after removal of the cover supplied with the reservoir 10, the cover assembly 100 is installed to the reservoir 10 over the filling port 14. The hinge assembly 104 is attached to the reservoir 10 by aligning the hinge block 190 with the hinge support 198 adjacent the filling port wall 108 so that the flange end 194 is away from the filling port wall 108 with the channels 212, 214 facing upwardly away from the reservoir 10. The end support 198 is slidably inserted between the cover attachment arms 114, 116 so that a suitable fastener, such as a pin or threaded fastener (not shown), can be inserted through the aligned pin apertures 122, 124 in the cover attachment arms 114, 116 and the reservoir aperture 202 in the support block 198.

The port cover 102 is attached to the hinge block 190 by slidably inserting the hinge arms 134, 136 along the center block 196 so that the pin apertures 146, 148 in the hinge arms 134, 136 are aligned with the cover aperture 200 through the center block 196. A suitable fastener, such as a pin or threaded fastener (not shown), is inserted through the aligned pin apertures 146, 148 and the cover aperture 200 so that the port cover 102 can pivot relative to the hinge block 190 and the reservoir 10.

As shown in FIG. 8, the port cover 102 can be maintained in a closed position over the filling port 14 through the use of a biasing mechanism, illustrated as a pair of springs 218, 220. As shown in FIG. 8, the springs 218, 220 comprise a pair of well-known helical springs having elongated arms, although any suitable spring or spring-like mechanism can be used. The springs 218, 220 are received within the channelways 150, 152 of the hinge arms 134, 136 with the pin (not shown) that connects the port cover 102 to the hinge block 190 inserted through the springs 218, 220 to retain the springs 218, 220 in place. One of the spring arms extends along the channelway 150, 152 and the other spring arm extends along the channel 212, 214. In this configuration, the springs 218, 220 will tend to maintain the port cover 102 in a closed position, but will enable the port cover 102 to be opened for filling of the reservoir 10. After filling of the reservoir 10, the springs 218, 220 return the port cover 102 to a closed position over the filling port 14.

Figure 9:
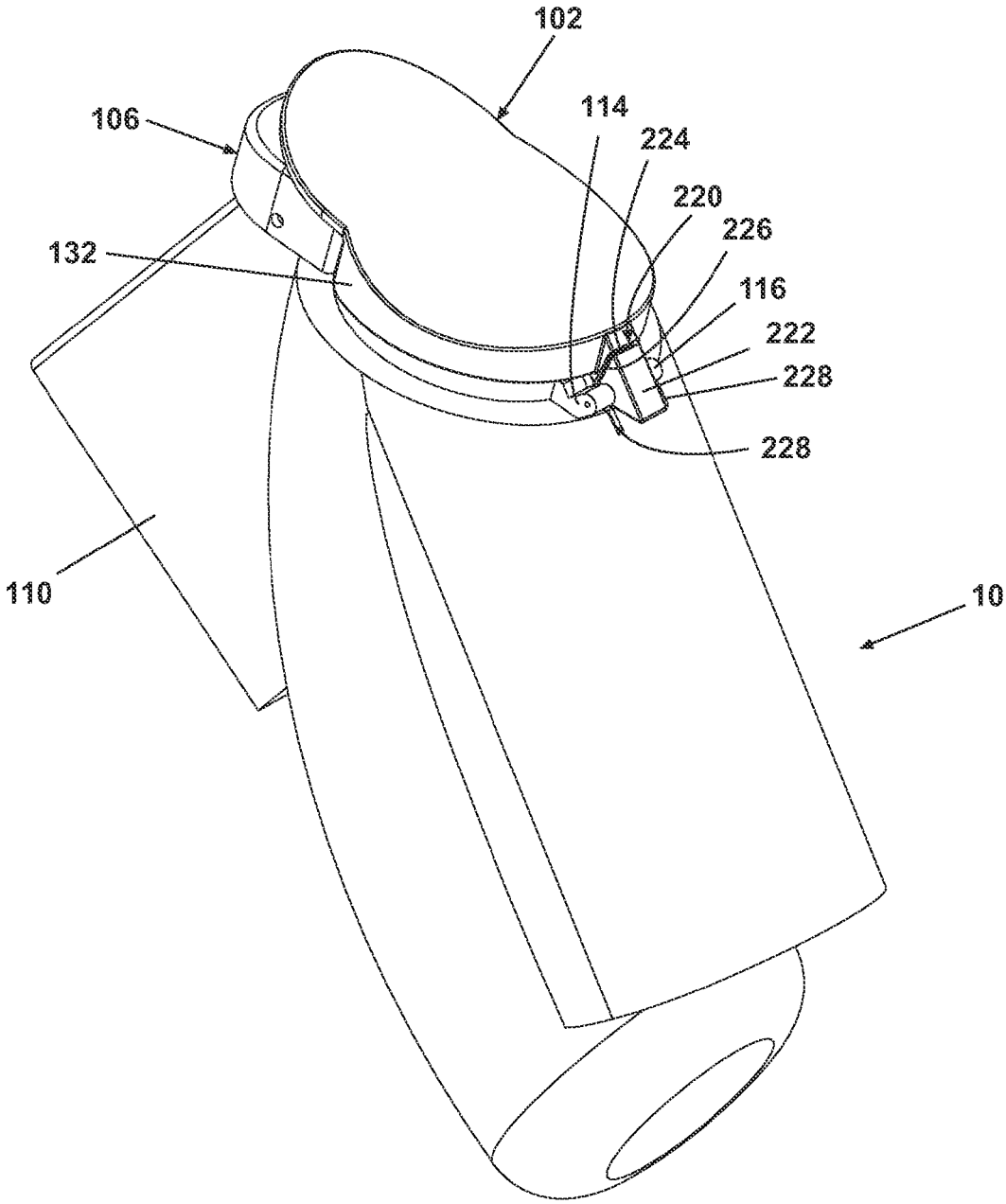
FIG. 9 is a perspective view of the paintball gun storage reservoir illustrated in FIG. 2 with a second embodiment of a filling port cover assembly according to the invention.
Figure 10:
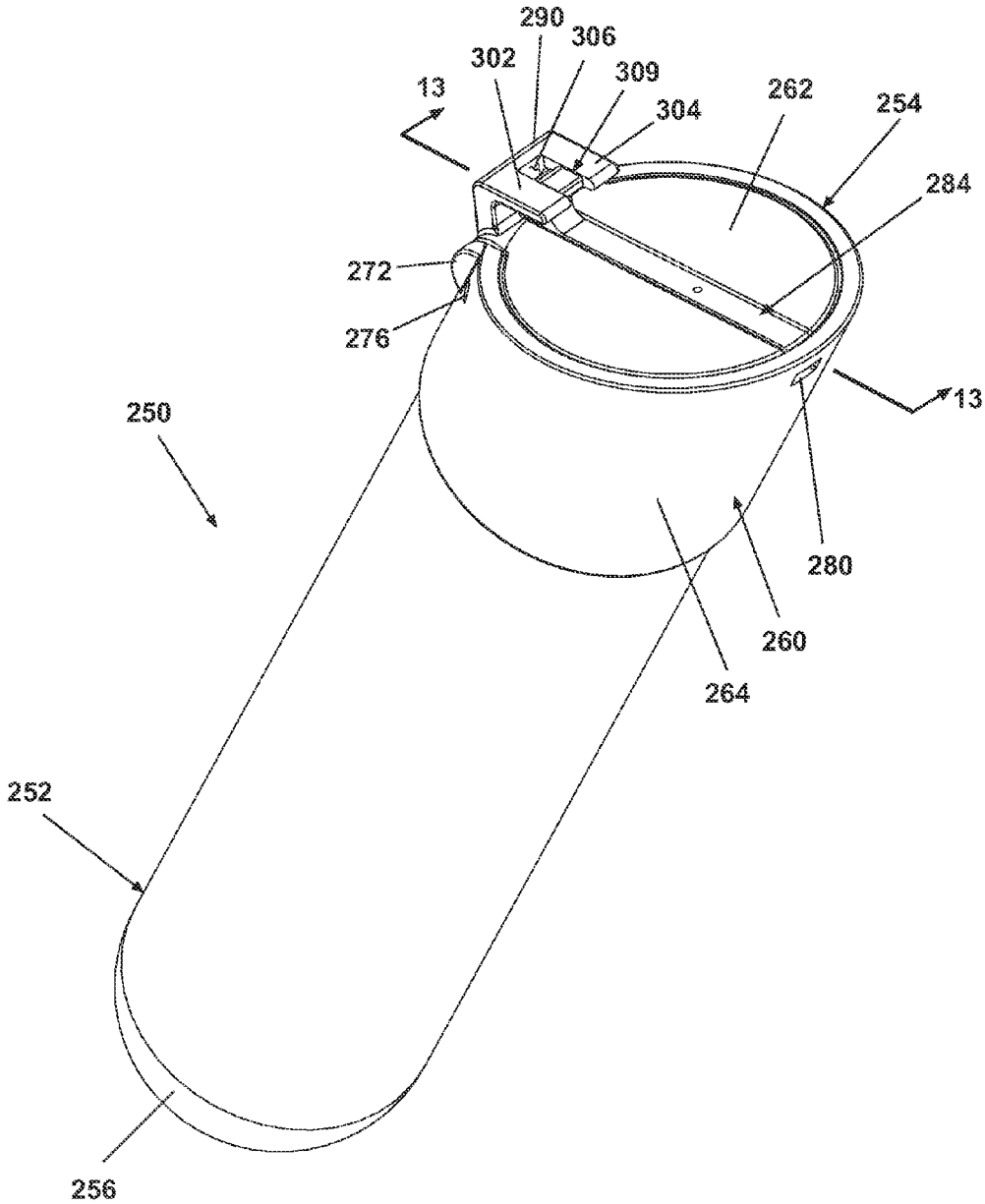
FIG. 10 is a perspective view of a first embodiment of a paintball reloading canister according to the invention for loading paintballs into the paintball gun storage reservoir illustrated in FIG. 2 and showing the canister in a closed configuration.

FIG. 9 shows an alternate embodiment of the port cover 102 hinge assembly. In this embodiment, the wall 132 transitions to a somewhat wedge-shaped hinge block 222 having a pin aperture extending therethrough (not shown) for coaxial alignment with the pin apertures 122, 124 and hinged attachment of the port cover 102 to the reservoir 10 through insertion of a suitable fastener, such as a pin or threaded fastener (not shown), through the pin apertures. The biasing mechanism comprises a somewhat U-shaped spring 221 comprising a crossmember 224 transitioning to a pair of parallel, spaced-apart tension members 226 extending orthogonally therefrom, which in turn transition to a pair of parallel, spaced-apart flexure members 228 extending laterally away from the tension members 226.

The spring 221 is placed over the hinge block 222 so that the flexure members 228 extend away from the port cover 102 and passing under the pin connecting the port cover 102 to the cover attachment arms 114, 116. The flexure members 228 are adapted for contact with the reservoir 10, thereby urging the port cover 102 to a closed position. As the port cover 102 is pivoted toward an open position for filling of the reservoir 10, the spring 221 will resist this movement by the flexure of the flexure members 228 relative to the tension members 226. After filling of the reservoir 10, the spring 221 will urge the port cover 102 to a closed position over the filling port 14.

Referring again to FIGS. 3 and 4, the tongue piece 106 is attached to the reservoir 10 by inserting the upper portion of the reservoir buttress 110 into the receptacle 178 so that the apex 170 faces away from the filling port 14 and the pin aperture 180 is coaxially aligned with the fastener aperture 112. A suitable fastener (not shown), such as a threaded screw or the like, is inserted through the pin aperture 180 into the fastener aperture 112 to fixedly attach the tongue piece 106 to the reservoir 10.

Although the cover assembly 100 comprising the port cover 102, the hinge assembly 104, and the tongue piece 106 has been described and illustrated as retrofit to a reservoir 10 supplied with a stock cover assembly, the cover assembly 100 can be molded or otherwise integrated into the reservoir 10 during the manufacturing process to provide a reservoir with the cover assembly 100 already installed.

FIGS. 10–17 illustrate an embodiment of a reloading canister 250 adapted for use preferably with the cover assembly 100 described above. The reloading canister 250 comprises a cylinder 252 and a cover assembly 254. The cylinder 252 is an elongated hollow body comprising a closed end 256 and an open end 258 defining a chamber for storage of paintballs. The open end 258 defines a discharge opening 259 and is adapted for operable register with the cover assembly 254. The cylinder 252 can be fabricated of any suitable material, and is preferably fabricated of a plastic material, which can be colored or clear.

Figure 17:
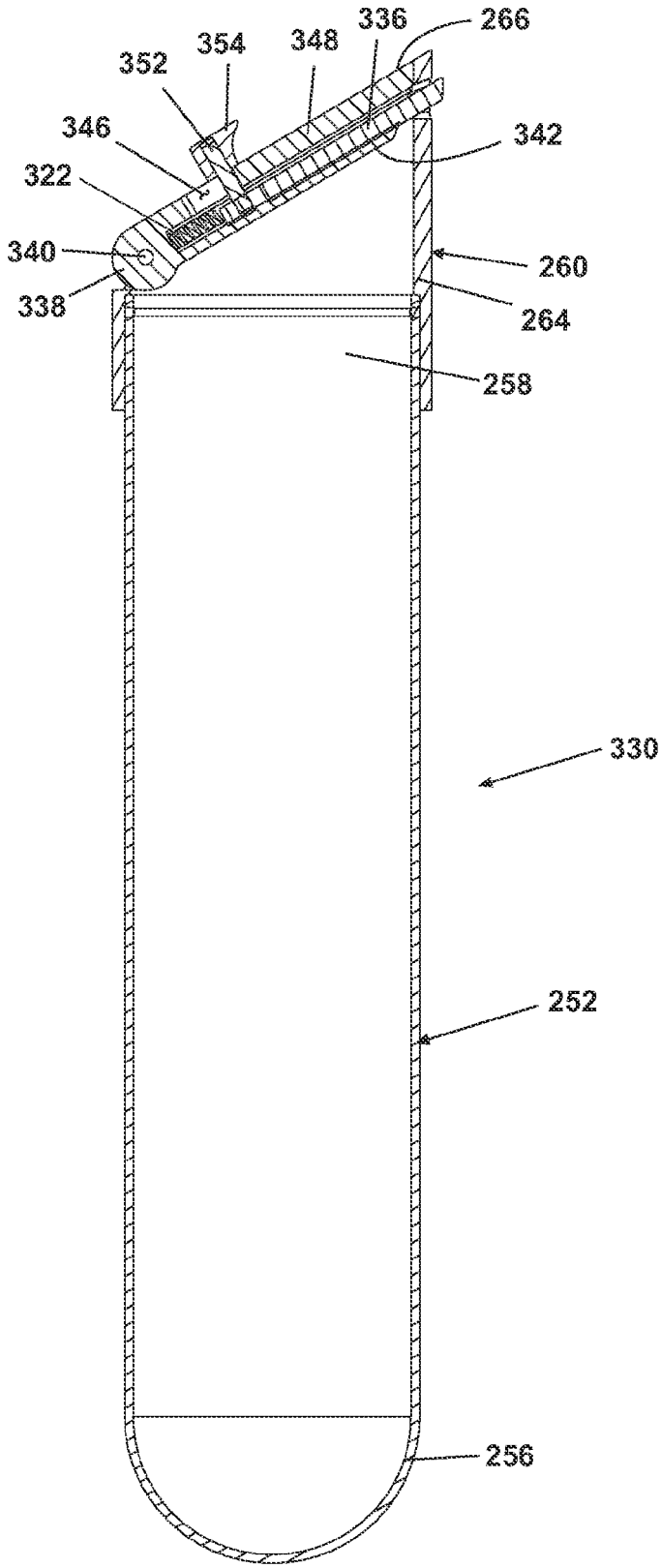
FIG. 17 is a sectional view of the paintball reloading canister taken along view line 17—17 of FIG. 16.

The cover assembly 254 comprises a collar 260 and a gate assembly 262. The collar 260 comprises an annular wall 264 adapted at a first end for operable register with the cylinder 252. The collar 260 can be attached to the cylinder 252 through a suitable means, such as a threaded connection, an adhesive, or welding. As shown in FIG. 17, a second end of the annular wall 264 terminates in a rim 266 which is inclined relative to the longitudinal axis of the collar 260 to define an apex 268. Adjacent the apex 268, an opening 280 extends through the wall 264.

Figure 12:
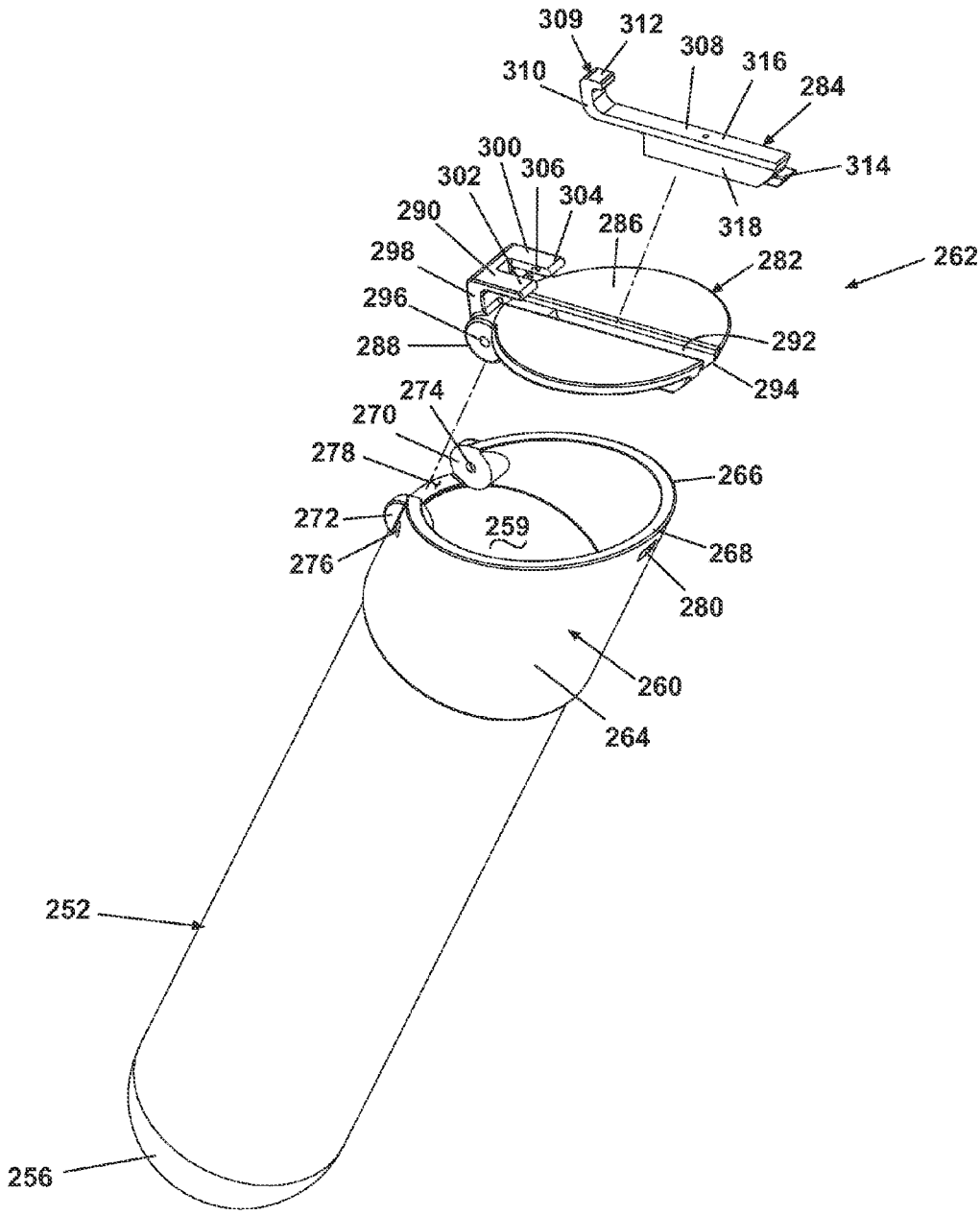
FIG. 12 is an exploded view of the paintball reloading canister illustrated in FIG. 10.

Referring now to FIG. 12, the wall 264 is provided with a slot 278 extending therethrough away from the rim 266 diametrically opposite the apex 268. A pair of cylindrical bearing blocks 270, 272 intersect the slot 278 in spaced-apart coaxial alignment. Each bearing block 270, 272 is provided with a pin aperture 274, 276 extending therethrough in coaxial alignment.

Referring now to FIG. 14, a gate 282 is a generally plate-like body 286 having a somewhat elliptical shape adapted for slidable receipt within the collar 260 adjacent the rim 266, and defining an apex 294. The gate 282 is provided with a latch bar channel 292 extending longitudinally therethrough and intersecting the apex 294. As shown in FIG. 14C, the channel 292 narrows at its upper portion to form a somewhat truncated triangular cross-section. The floor of the channel 292 is provided with a slot 324 extending partway therealong.

Diametrically opposite the apex 294 is a generally cylindrical hinge block 288 having a pin aperture 296 extending coaxially therethrough. The hinge block 288 is adapted for insertion into the slot 278 and slidable register with the bearing blocks 270, 272. Extending orthogonally upwardly away from the hinge block 288 is a latch bar stop 290 comprising a back wall 298 and a top wall 300 and extending orthogonally from the back wall 298 in parallel, spaced-apart juxtaposition to the plate 286. The top wall 300 is provided with a longitudinal slot 306 extending therethrough to divide the top wall 300 into a pair of fingers 302, 304.

Referring now to FIG. 15, a latch bar 284 is an elongated member comprising a center beam 308 and a pivot boss 309. The center beam 308 comprises a top portion 316 and a block portion 318. The block portion 318 has a length somewhat less than the length of the top portion 316 to define a spring space 320. The top portion 316 terminates adjacent the spring space 320 in the pivot boss 309.

The pivot boss 309 comprises a back wall 310 extending orthogonally upwardly from the top portion 316 and a top wall 312 extending orthogonally away from the back wall 310 in parallel, spaced-apart juxtaposition with the top portion 316. The width of the pivot boss 309 is adapted for slidable register with the slot 306.

Figure 15A:
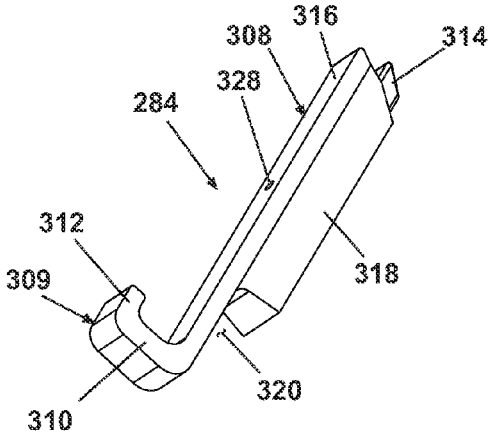
FIGS. 15A–E are perspective, plan, and elevation views of a latch bar comprising a portion of the paintball reloading canister illustrated in FIG. 10.
Figure 15B:
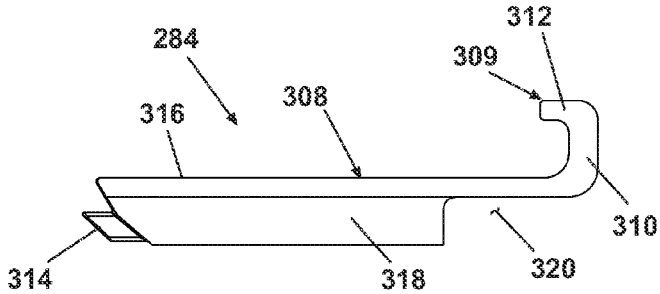
Figure 15C:
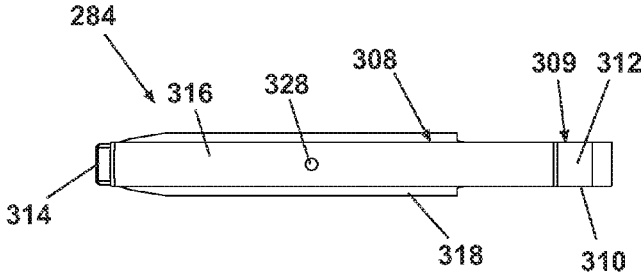
Figure 15E:
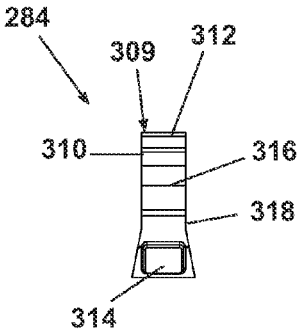
Figure 15D:
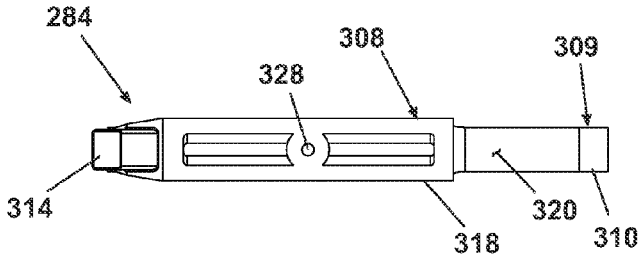
Figure 16:
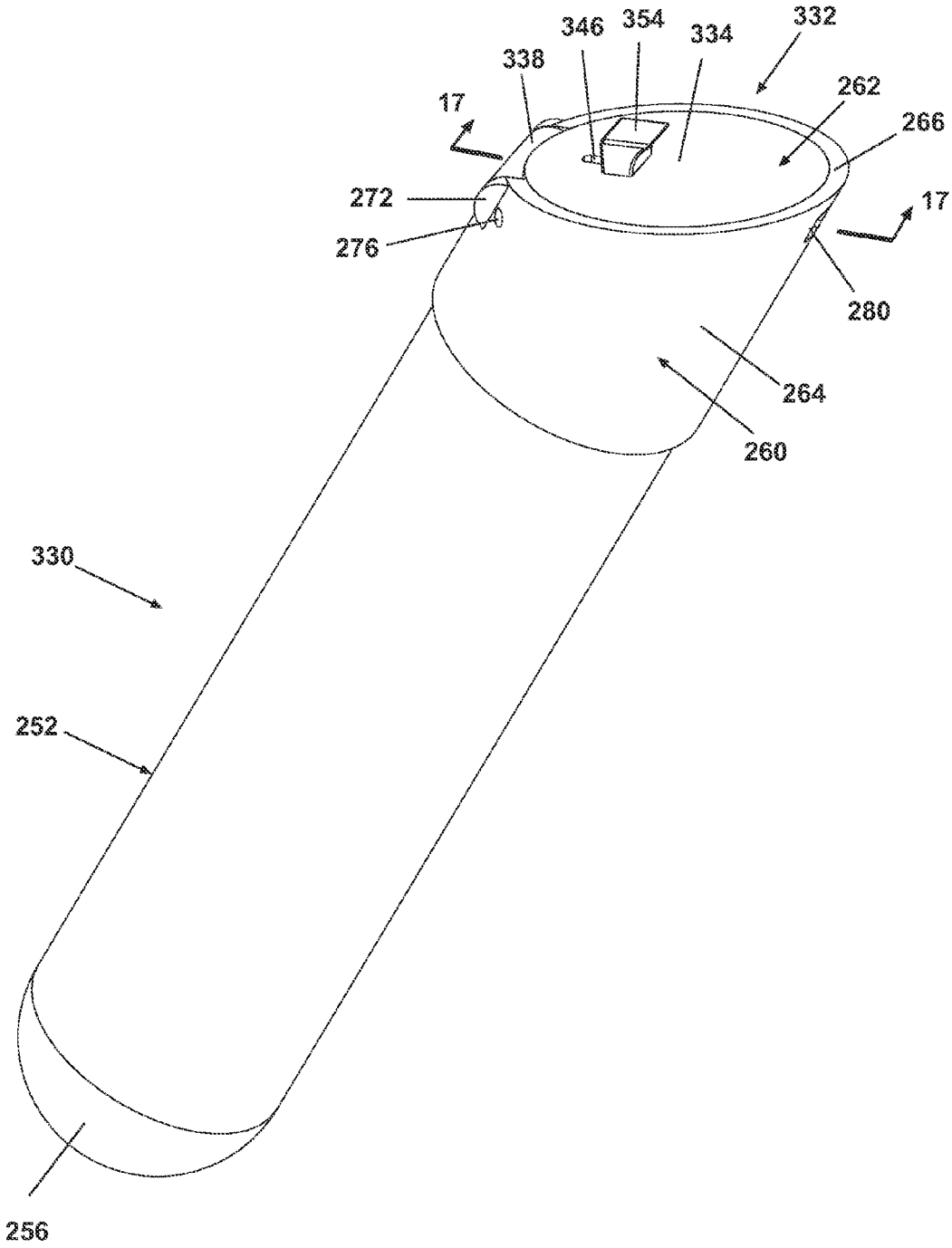
FIG. 16 is a perspective view of a second embodiment of a paintball reloading canister according to the invention.

The block portion 318 has a somewhat truncated triangular cross-section adapted for slidable register with the latch bar channel 292. The block portion 318 terminates in a latch pin 314 extending longitudinally therefrom away from the pivot boss 309. As shown in FIG. 15B, the latch pin 314 can be provided with an inclined face 315. Extending orthogonally through the center beam 308 is an aperture 328.

The latch bar 284 is attached to the gate 282 by slidably inserting the latch bar 284 into the latch bar channel 292 with the pivot boss 309 in slidable communication with the slot 306. A suitable fastener, such as a threaded screw (not shown), is installed through the slot 324 into the aperture 328 to secure the latch bar 284 to the gate 282 while enabling the latch bar 284 to slide within the channel 292. A helical spring 322 is received in the channel 292 within the spring space 320 to urge the latch bar 284 away from the pivot boss 309, while enabling the latch bar 284 to be moved toward the pivot boss 309, as hereinafter described. A force applied to the pivot boss 309 parallel to the gate 282 will tend to rotate the gate 282 around an axis passing through the pin aperture 296.

Figure 11:
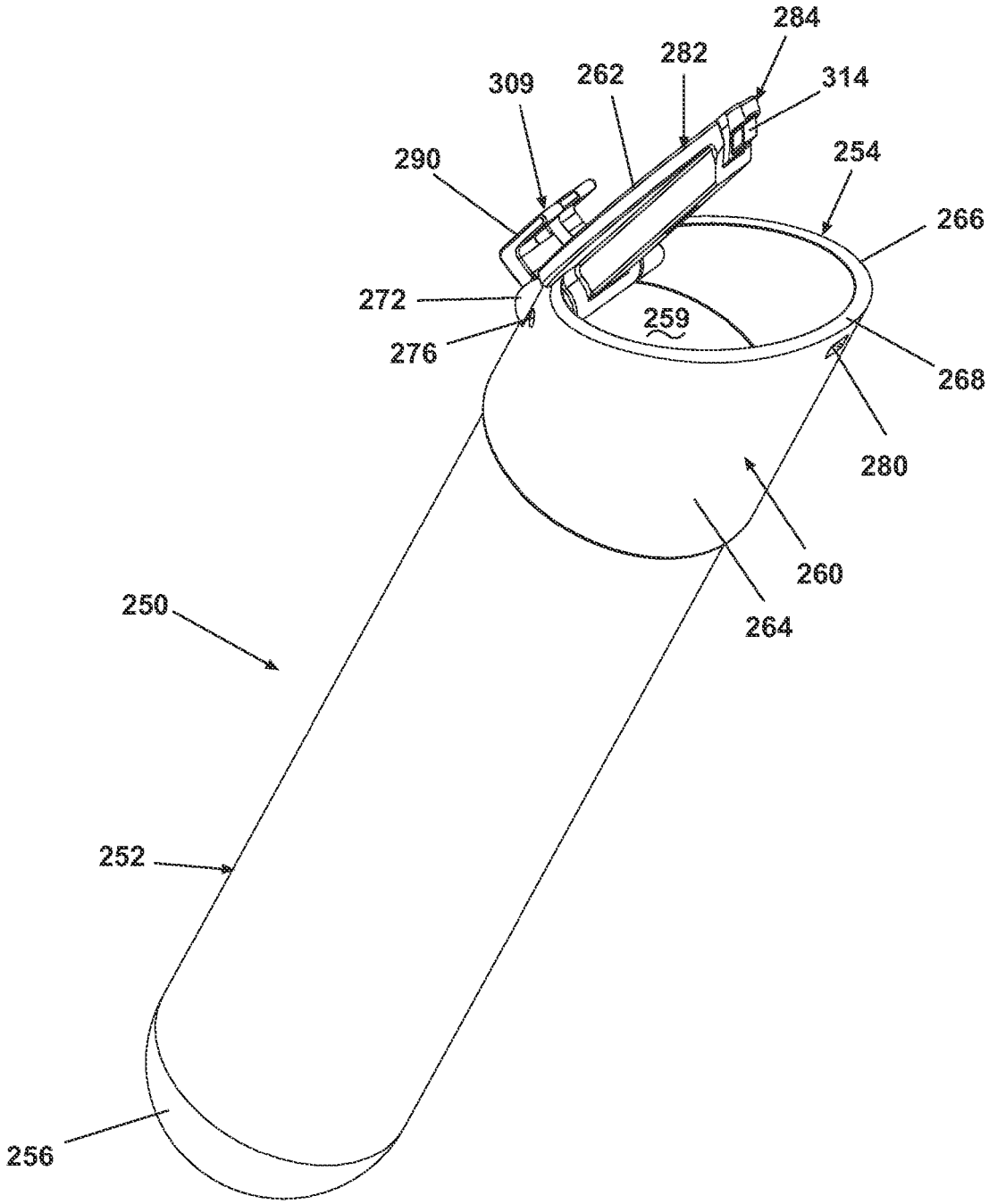
FIG. 11 is a perspective view of the paintball reloading canister illustrated in FIG. 10 showing the canister in an open configuration.
Figure 13:
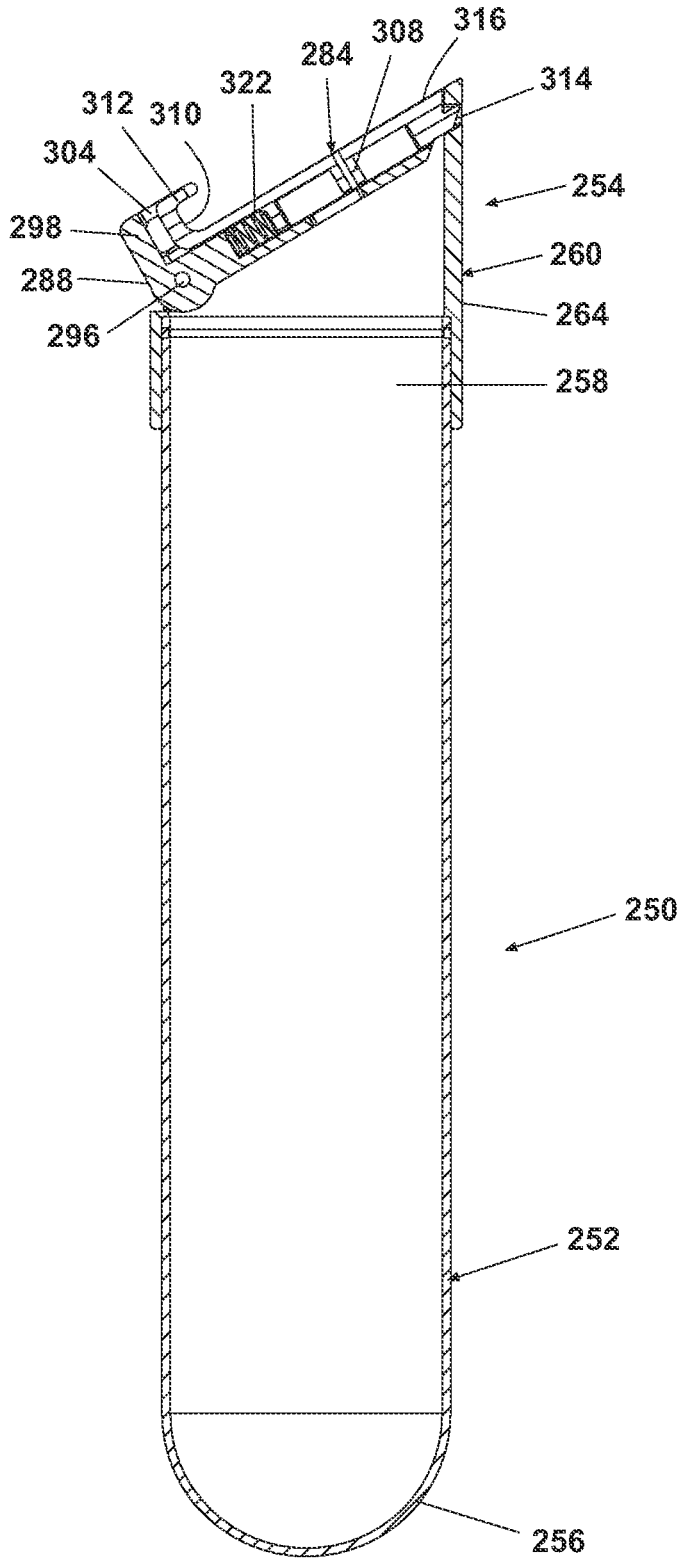
FIG. 13 is a sectional view of the paintball reloading canister taken along view line 13—13 of FIG. 10.
Figure 14A:
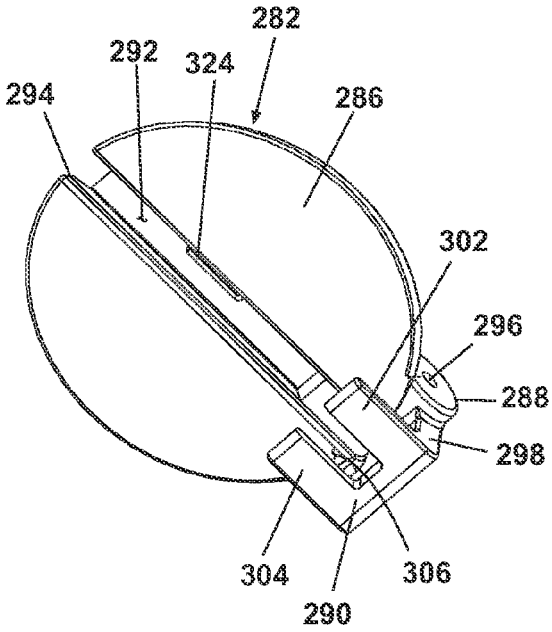
FIGS. 14A–D are perspective, plan, and elevation views of a gate comprising a portion of the paintball reloading canister illustrated in FIG. 10.
Figure 14B:
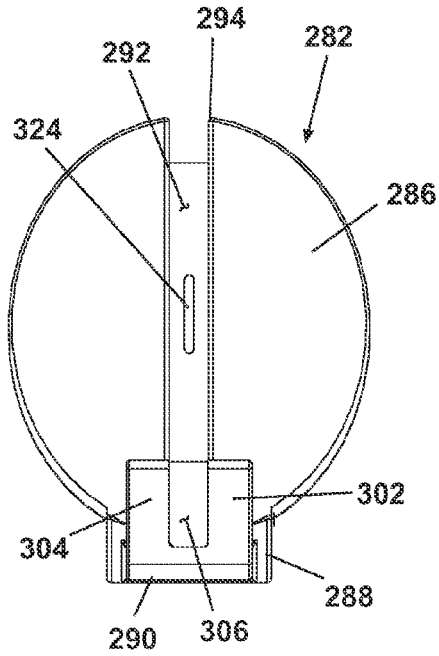
Figure 14C:
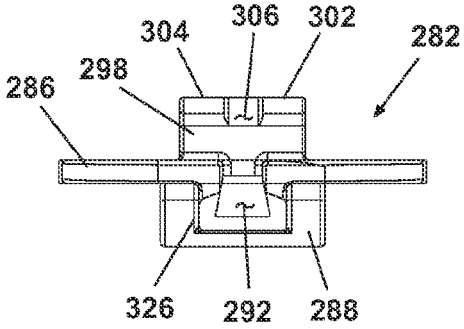
Figure 14D:
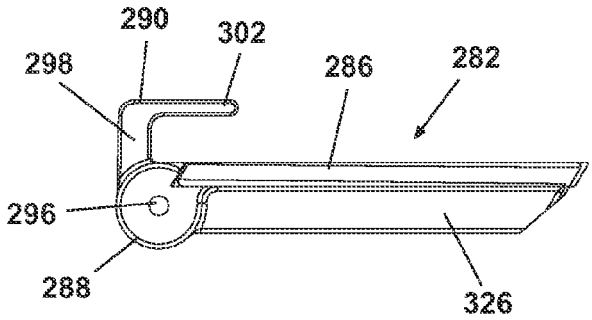

As shown in FIGS. 11 and 13, with the latch bar 284 urged away from the pivot boss 309, the latch pin 314 will extend beyond the perimeter of the gate 282 in order to engage the opening 280 and secure the gate assembly 262 against opening. With the latch bar 284 urged toward the pivot boss 309, the latch pin 314 will be withdrawn from the opening 280, enabling the gate 282 to open. The gate 282 can be closed by pushing the gate 282 to the closed position until the latch pin 314 engages the opening 280. The inclined face 315 of the latch pin 314 will facilitate the closing of the gate 282. Optionally, a biasing mechanism, such as a spring or spring-like device (not shown) can be employed, preferably in cooperation with the hinged attachment of the gate 282 to the collar 260, to urge the gate 282 to a closed position, in a manner similar to that described with respect to the reservoir cover assembly 100.

Figure 18:
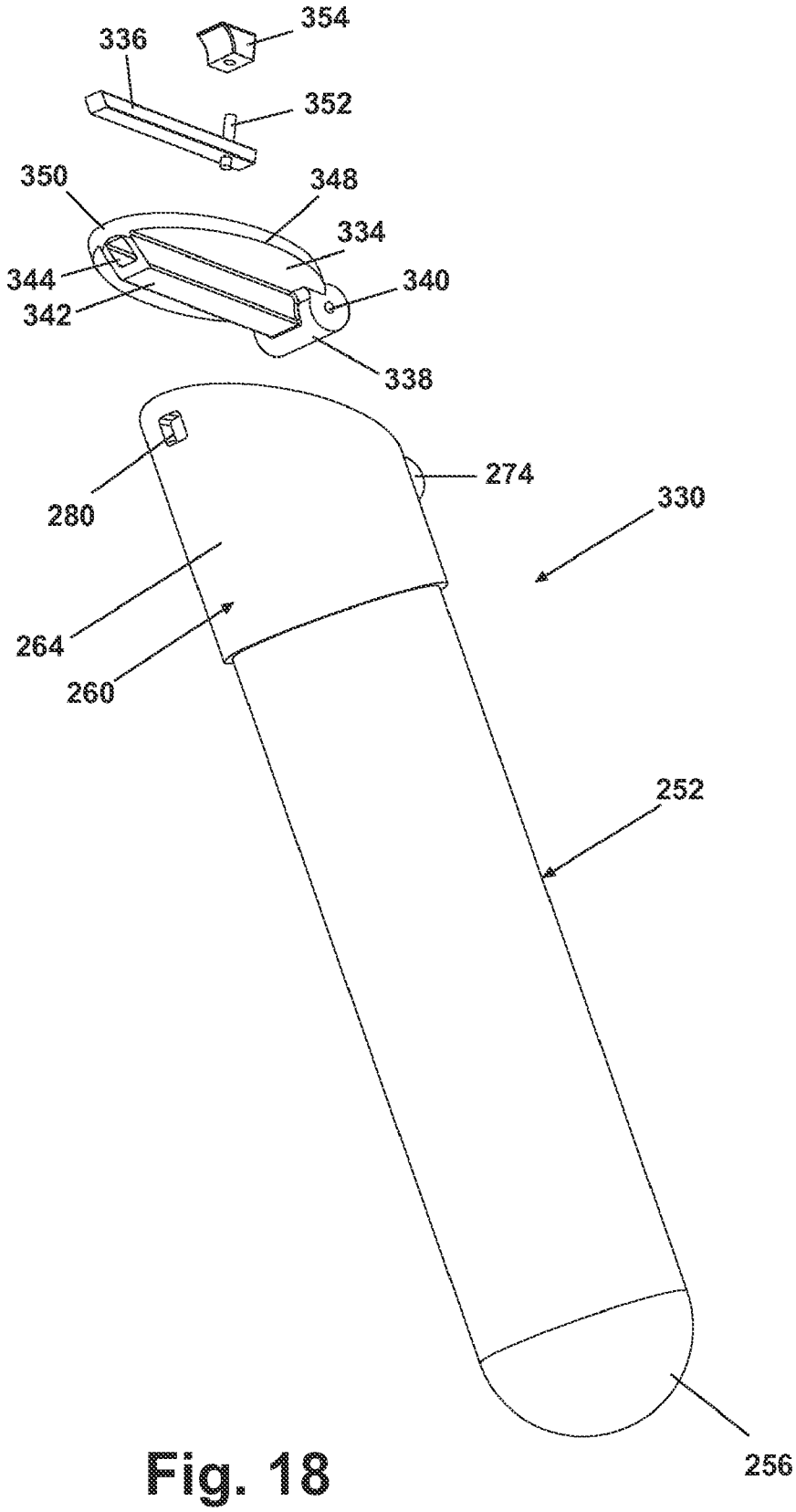
FIG. 18 is a first exploded view of the paintball reloading canister illustrated in FIG. 16.
Figure 19:
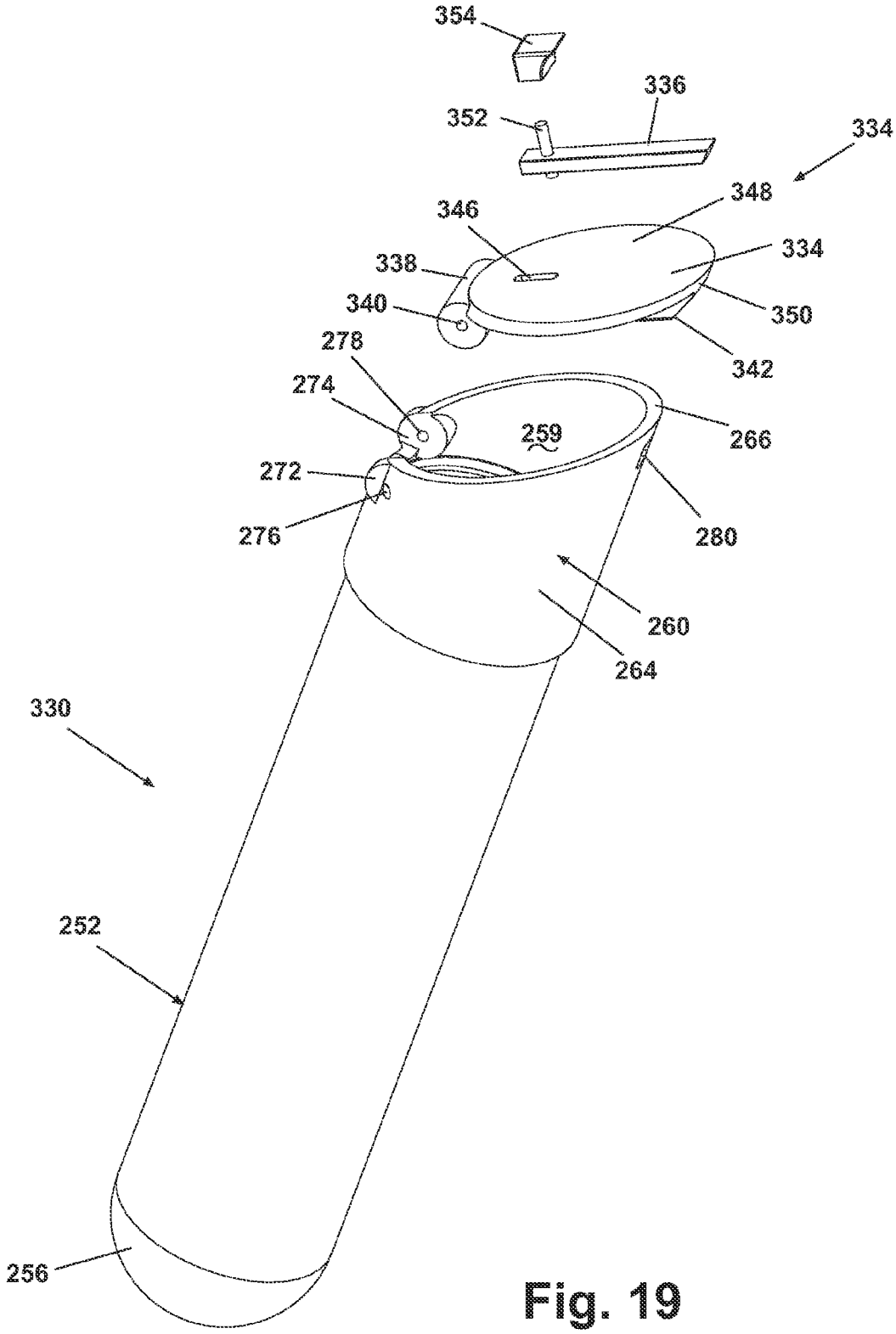
FIG. 19 is a second exploded view of the paintball reloading canister illustrated in FIG. 16.

FIGS. 17–19 illustrate an optional embodiment of the reloading canister 330 comprising a cylinder 252 and an alternate cover assembly 332. The cover assembly 332 comprises a gate 334 comprising a generally elliptical plate 348 and a latch bar 336. The plate 348 transitions at one end to a hinge block 338 and to a diametrically-juxtaposed apex 350. A latch bar support 342 with an enclosed latch bar channel 344 extends along an underside of the gate 334 between the hinge block 338 and the apex 350. The latch bar channel 344 is closed at the hinge block 338 and open at the apex 350. A slot 346 extends longitudinally through the gate 334 in communication with the latch bar channel 344 adjacent the hinge block 338.

The hinge block 338 is similar in structure and operation to the hinge block 288, and is provided with a pin aperture 340 extending coaxially therethrough for hingedly attaching the gate 334 to the bearing blocks 270, 272. The latch bar 336 is an elongated, generally rectilinear member adapted for slidable register with the latch bar channel 344. The latch bar 336 terminates at a first end in a latch pin 356 adapted to engage the opening 280. As shown in FIG. 17, the latch pin 356 can be provided with an inclined face 358. Adjacent the second end of the latch pin 356, a post 352 is fixedly attached to the latch bar 336 orthogonal thereto. The latch bar 336 is provided with an aperture (not shown), and the post 352 is adapted to extend outwardly through the slot 346, preferably orthogonal to the gate 334. A pivot boss 354 is adapted with an aperture (not shown) for insertion of the post 352, which is fixedly attached therein. A helical spring (not shown) can be received within the latch bar channel 344 at the closed end to bear against the latch bar 336 and thereby urge the latch bar 336 away from the hinge block 338. When the gate 334 is in a closed position, the latch pin 356 will engage the opening 280. When the pivot boss 354 is moved toward the hinge block 338, against the force of the spring, the latch pin 356 will be removed from the opening 280, thereby enabling the gate 334 to be opened. The gate 334 can be closed by pushing the gate 334 to the closed position until the latch pin 356 engages the opening 280. The inclined face 358 of the latch pin 356 will facilitate the closing of the gate 334.

Figure 20:
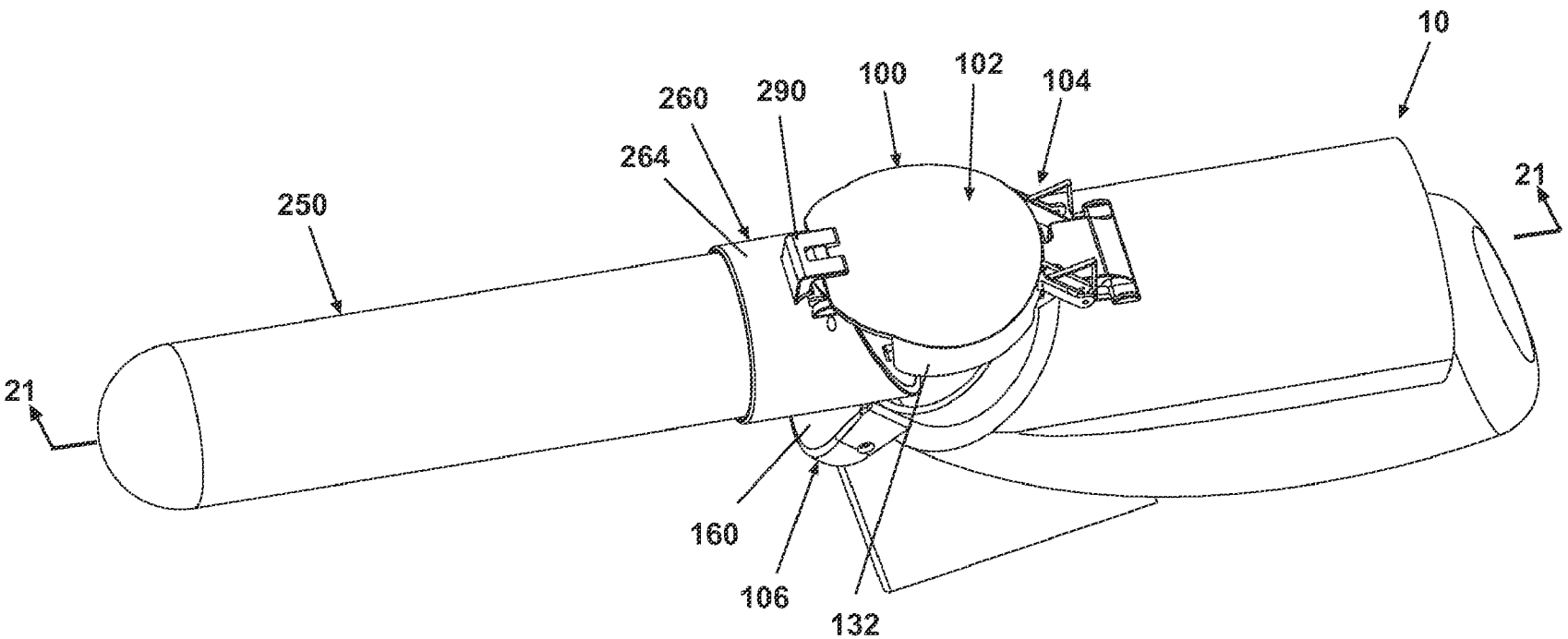
FIG. 20 is a perspective view of the paintball reloading canister illustrated in FIG. 10 positioned relative to the paintball gun storage reservoir illustrated in FIG. 1 for loading of paintballs from the paintball reloading canister into the paintball gun storage reservoir.
Figure 21:
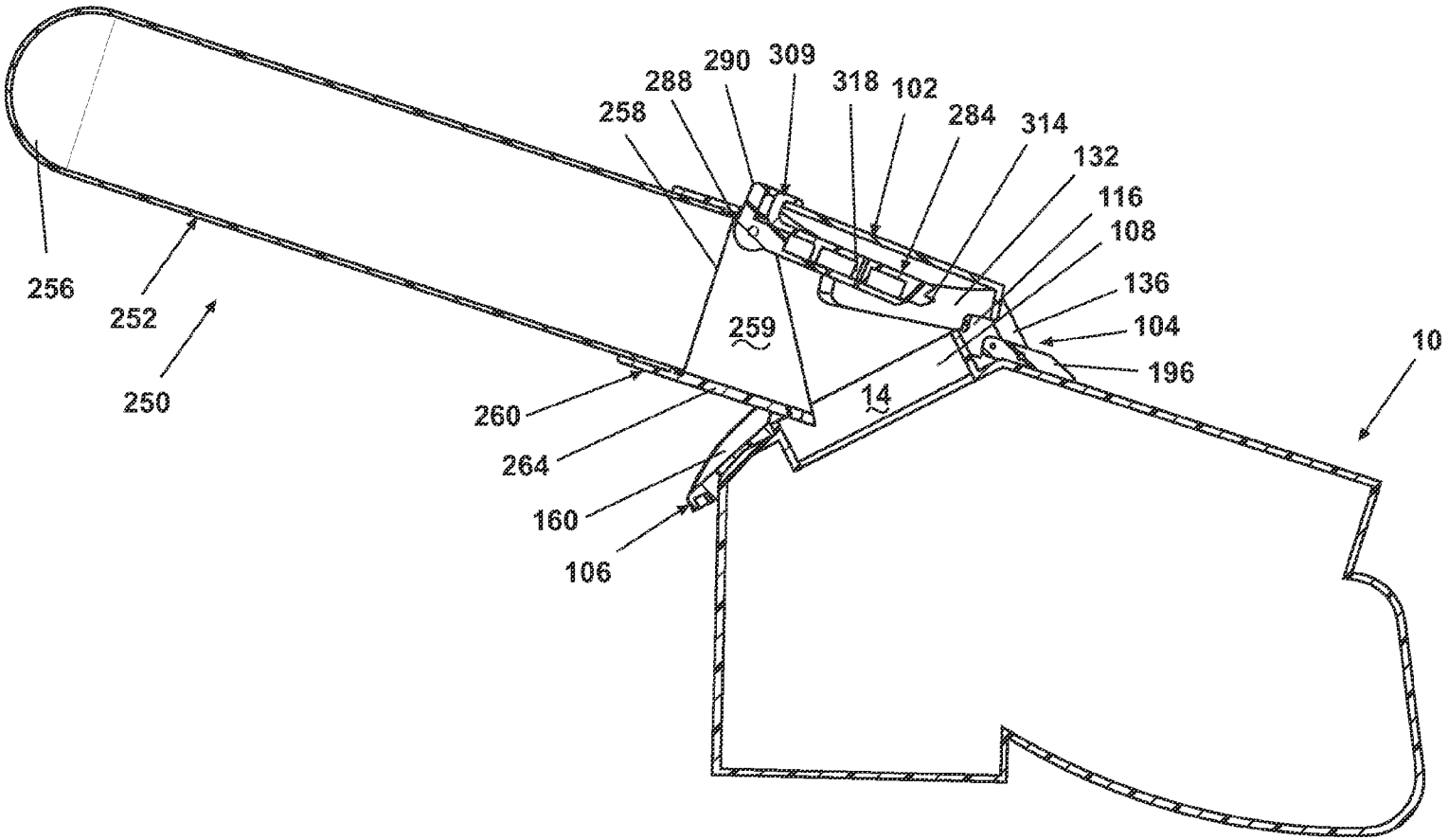
FIG. 21 is a sectional view of the paintball reloading canister and paintball gun storage reservoir taken along view line 21—21 of FIG. 20.

FIGS. 20 and 21 illustrate the cooperative engagement of the reloading canister 250 with the reservoir 10 having the cover assembly 100 during the paintball filling process. FIGS. 22–26 illustrate the filling of the reservoir 10 from the reloading canister 250, which will now be described.

Figure 22:
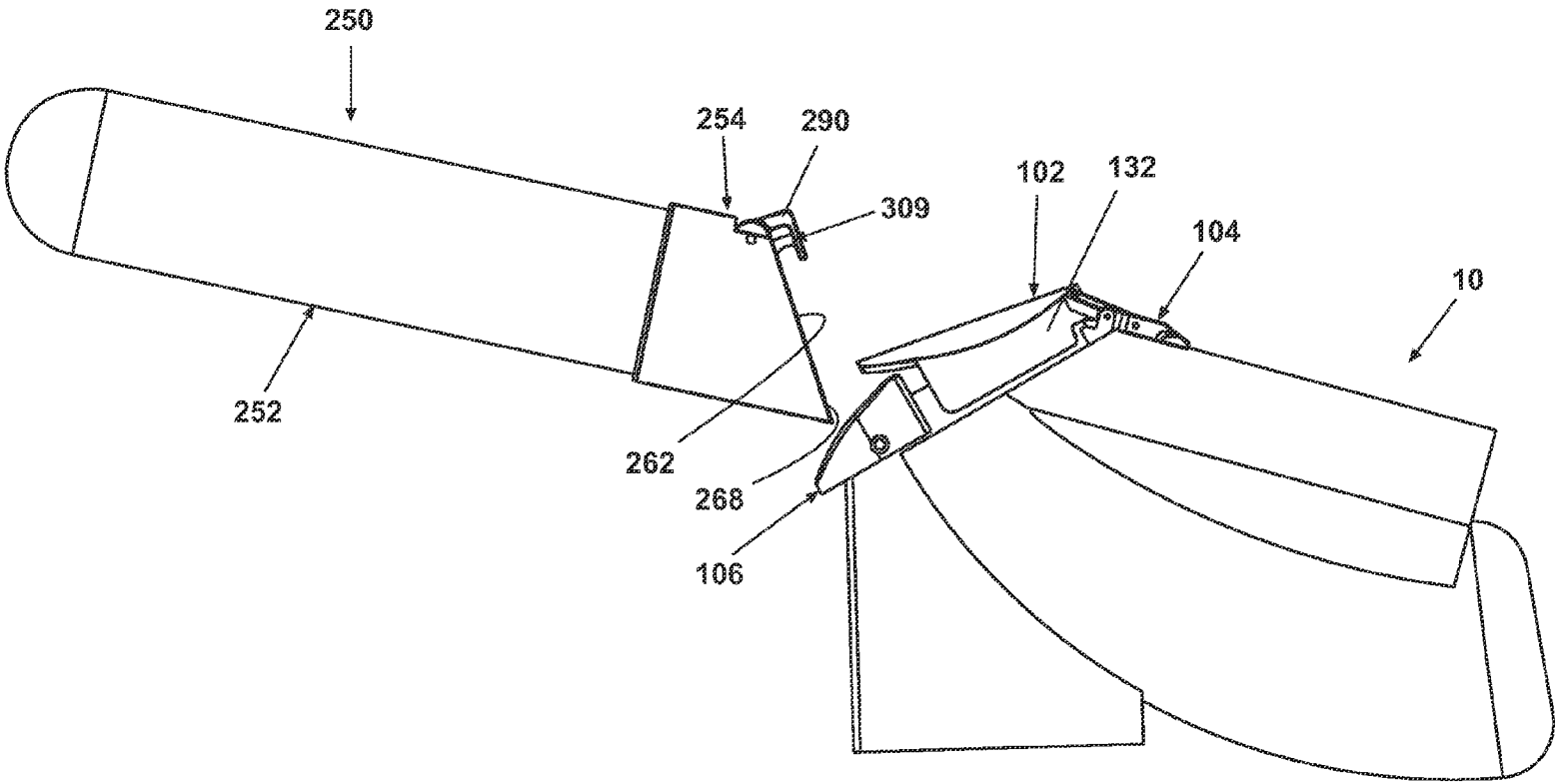
FIG. 22 is a side elevation view of the paintball reloading canister and paintball gun storage reservoir illustrated in FIG. 20 showing the paintball reloading canister in a first position for loading paintballs into the paintball gun storage reservoir.

Referring to the Figures, and particularly to FIG. 22, the reloading canister 250 with a supply of paintballs 52 contained therein is brought toward the reservoir 10, which, it will be understood, is mounted to a paintball gun (not shown). The user of the paintball gun grips the reloading canister 250 with one hand while gripping the paintball gun with the other hand. The reloading canister 250 is inclined toward the filling port 14 so that the apex 268 of the collar 260 approaches the trough 172 of the tongue piece 106. The gate assembly 262 remains closed, thereby preventing spillage of the paintballs 52, through engagement of the latch pin 314 in the opening 280, and, optionally, the action of a biasing mechanism urging the gate assembly 262 to the closed position.

Figure 23:
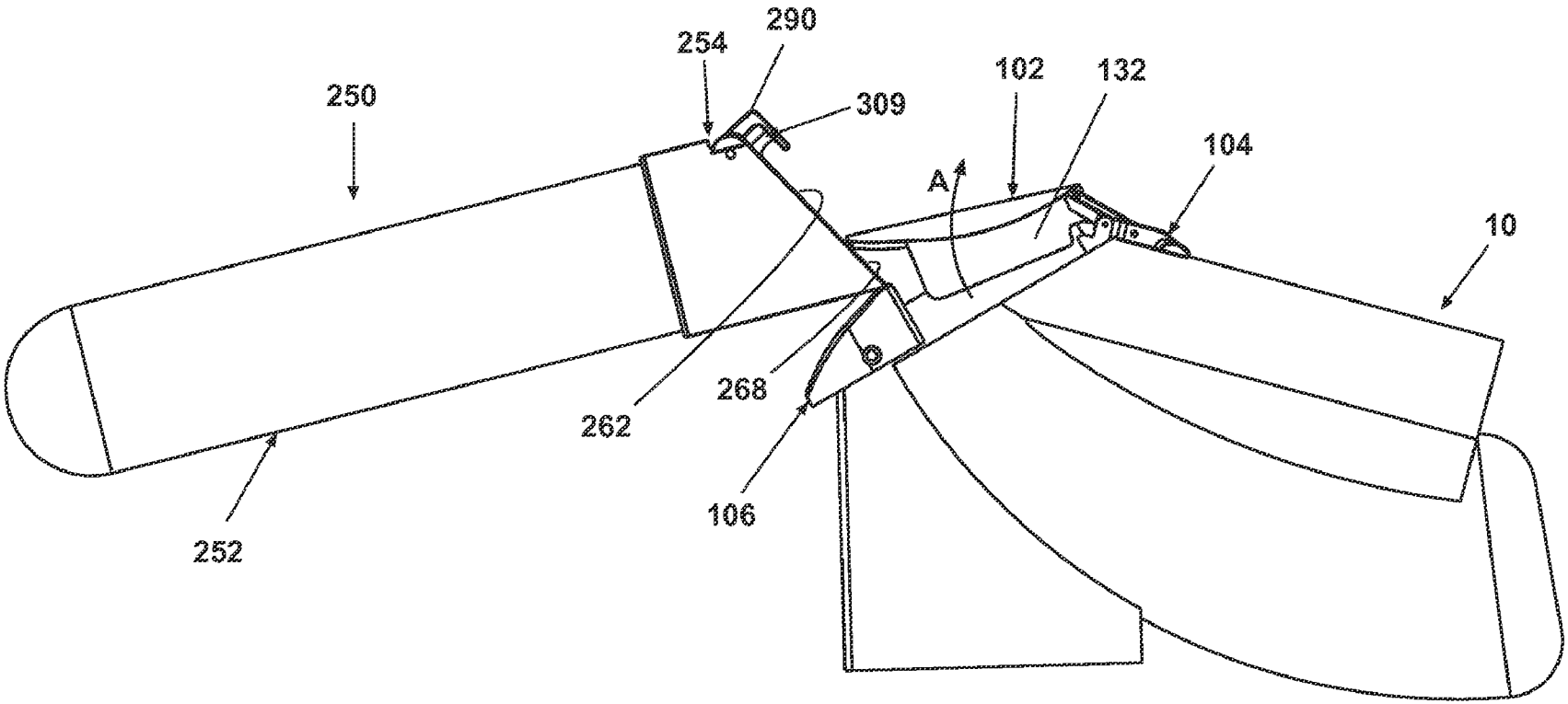
FIG. 23 is a side elevation view of the paintball reloading canister and paintball gun storage reservoir illustrated in FIG. 20 showing the paintball reloading canister in a second position for loading paintballs into the paintball gun storage reservoir.

As shown in FIG. 23, the apex 268 is slidably moved along the trough 172 toward the filling port 14 and the edge 131 of the port cover 102. As the apex 268 moves along the trough 172, the edge 131 engages the outer surface of the gate 282 and begins to travel along the gate 282 toward the latch bar stop 290. This urges the port cover 102 to begin to pivot upwardly toward an open position, as illustrated by the vector A in FIG. 23.

Figure 24:
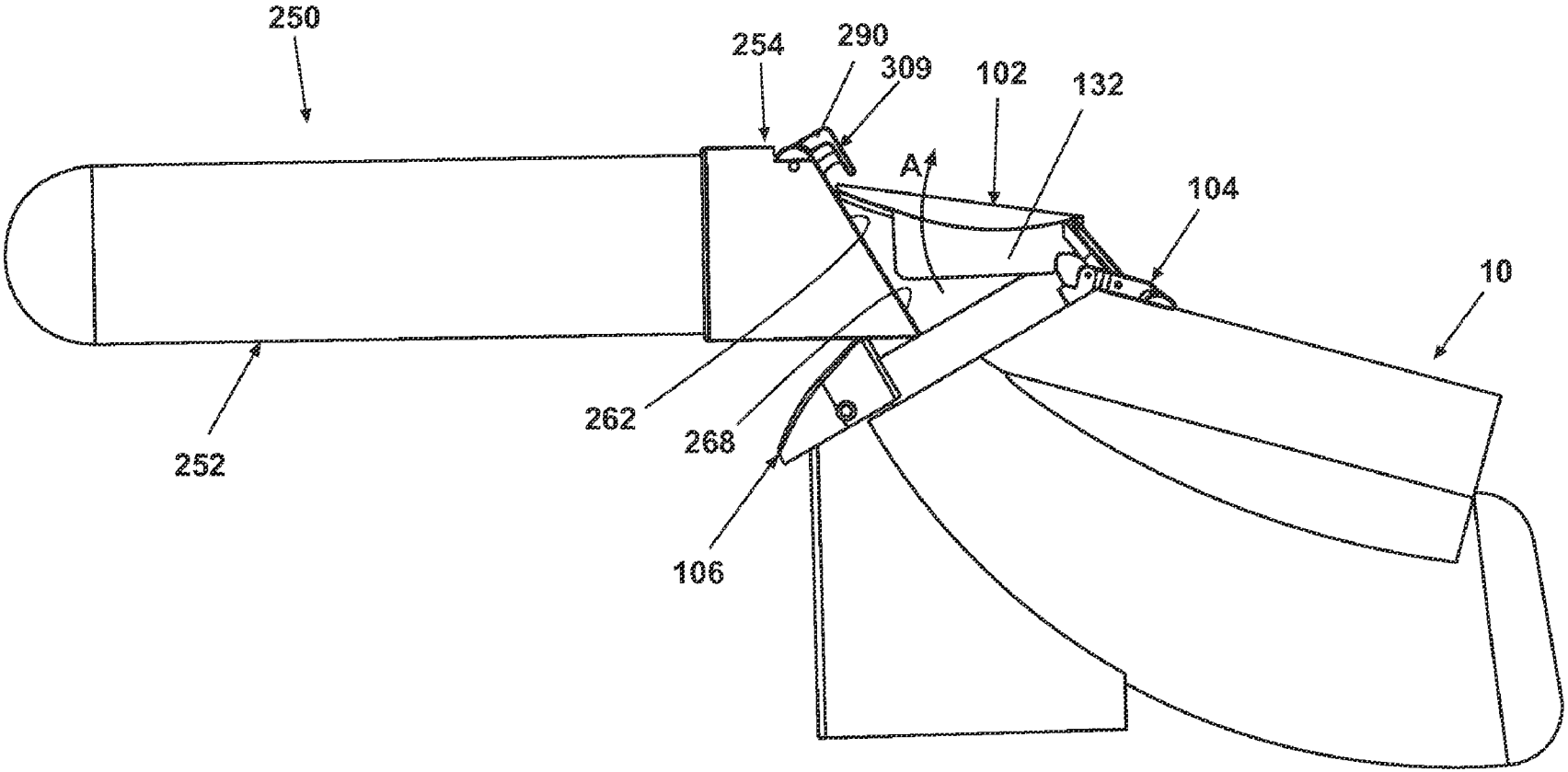
FIG. 24 is a side elevation view of the paintball reloading canister and paintball gun storage reservoir illustrated in FIG. 20 showing the paintball reloading canister in a third position for loading paintballs into the paintball gun storage reservoir.
Figure 25:
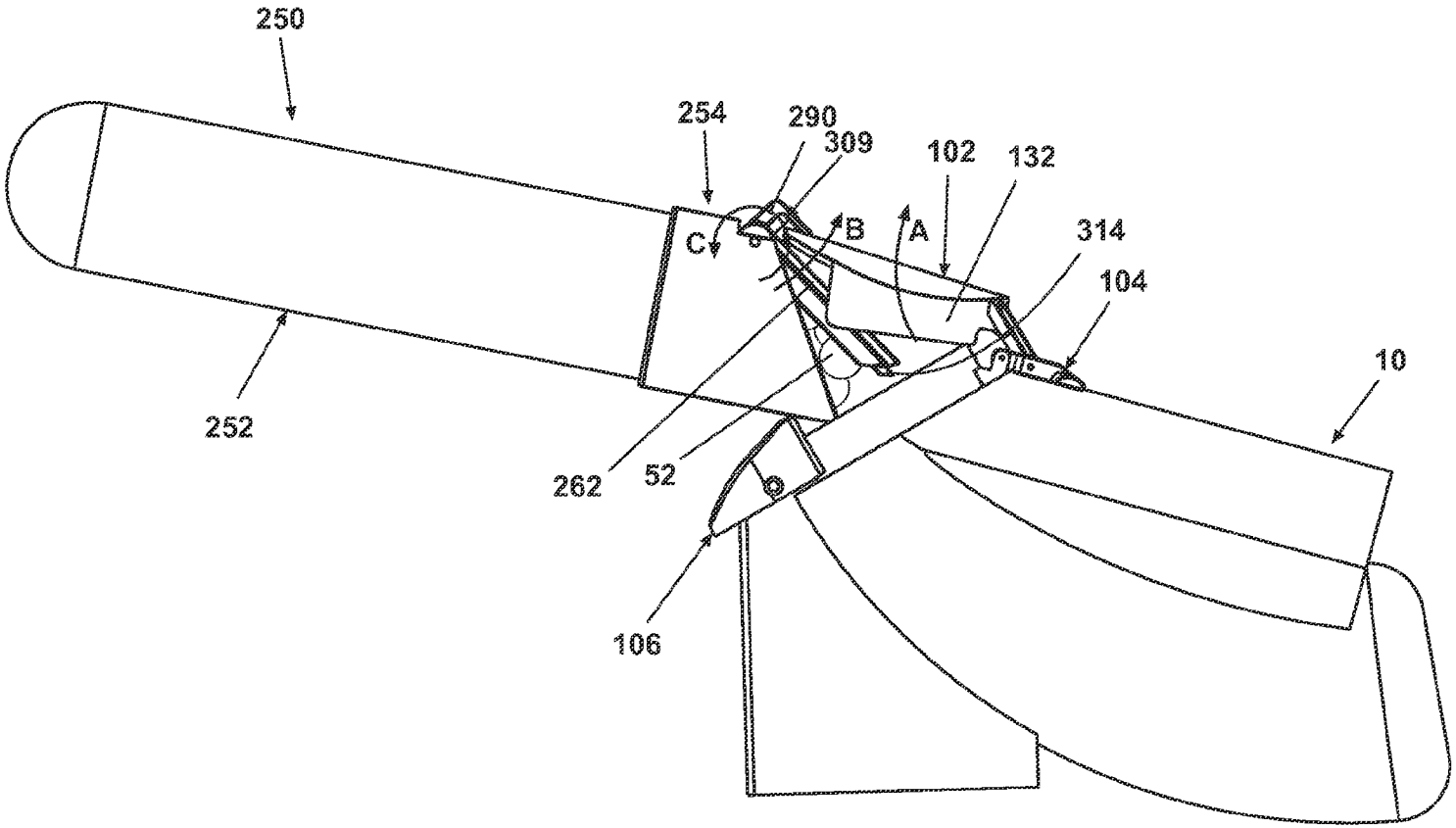
FIG. 25 is a side elevation view of the paintball reloading canister and paintball gun storage reservoir illustrated in FIG. 20 showing the paintball reloading canister in a fourth position for loading paintballs into the paintball gun storage reservoir.
Figure 26:
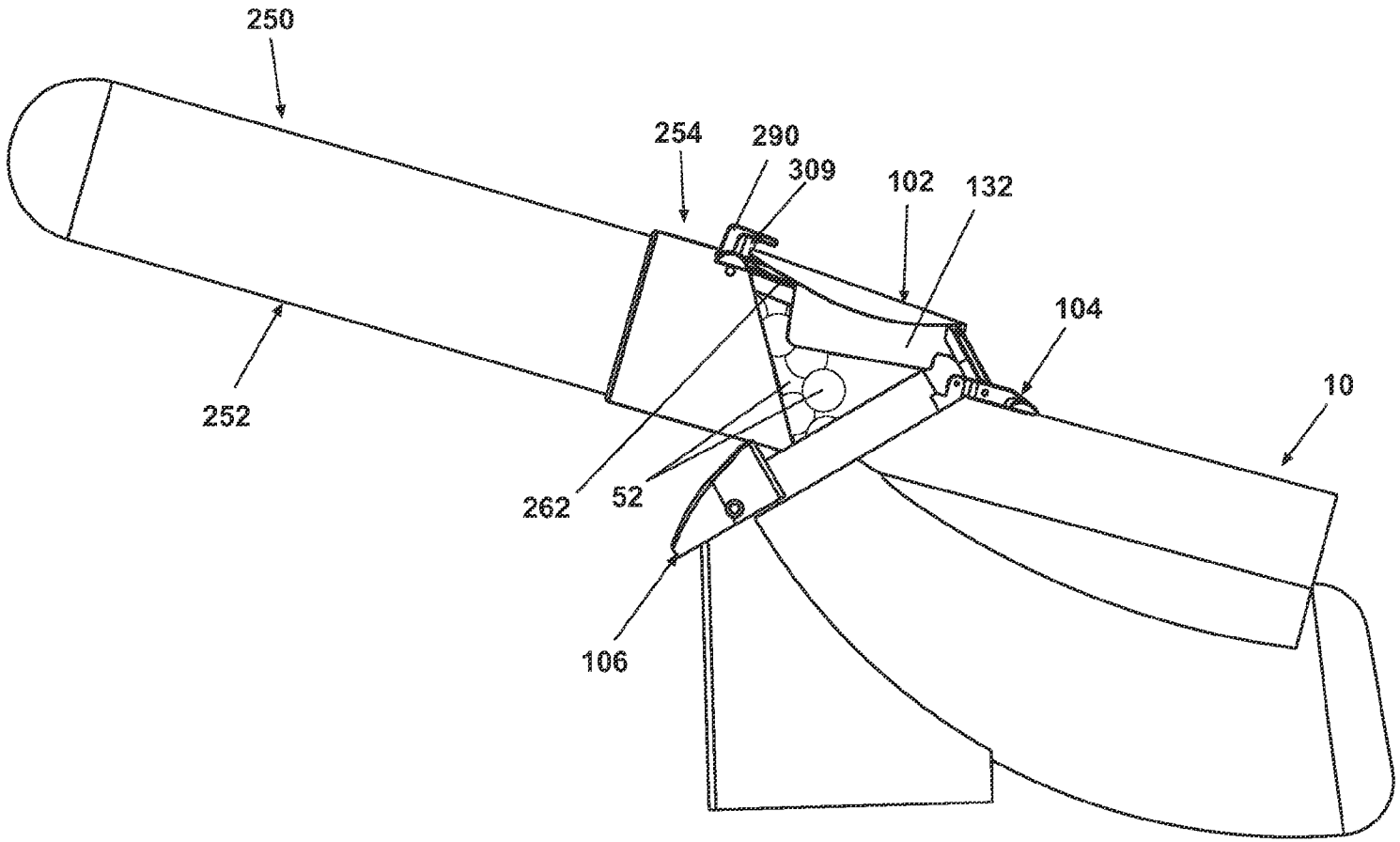
FIG. 26 is a side elevation view of the paintball reloading canister and paintball gun storage reservoir illustrated in FIG. 20 showing the paintball reloading canister in a fourth position for loading paintballs into the paintball gun storage reservoir.

As shown in FIG. 24, continued movement of the reloading canister 250 toward the filling port 14 will continue to urge the port cover 102 toward a fully open position, as illustrated by the vector A in FIG. 24, and the edge 131 will engage the latch bar stop 290. As shown in FIG. 25, when the edge 131 engages the latch bar stop 290, the pivot boss 309 will be urged away from the filling port 14, and the latch pin 314 will be withdrawn from the opening 280, thereby enabling the gate 282 to pivot to an open position. The force of the port cover 102 against the latch bar stop 290 and the pivot boss 309 will impart an opening moment to the gate 282, as illustrated by the moment vector C in FIG. 25. The gap 158 in the port cover wall 132 will enable the gate 282 to pivot upwardly to engage the underside of the port cover 102, as illustrated in FIG. 26. With the gate 282 in a fully open position, the paintballs 52 can freely enter the filling port 14 to fill the reservoir 10.

After filling has been completed, the reloading canister 250 must be removed from the filling port 14. As the reloading canister 250 is moved away from the filling port 14, the port cover 102 will be urged to the closed position by the biasing mechanism, thereby preventing spillage of paintballs from the reservoir. The gate 282 will be urged to the closed position after disengagement of the latch bar stop 290 from the edge 131 if the gate assembly 262 comprises a biasing mechanism. Otherwise, the gate 282 can be left open, or closed manually.

Referring now to FIGS. 27–35, an alternate embodiment of the paintball reloading canister will be described with respect to an alternate paintball storage reservoir 10 such as the Ricochet 2K™ manufactured and marketed by Ricochet Development LLC of El Mirage, Ariz. The storage reservoir 10 is provided with an alternate embodiment of a cover comprising a membrane-type, self-closing cover assembly 16, which extends across the filling port 14 to prevent paintballs from being inadvertently spilled from the reservoir 10.

Figure 27:
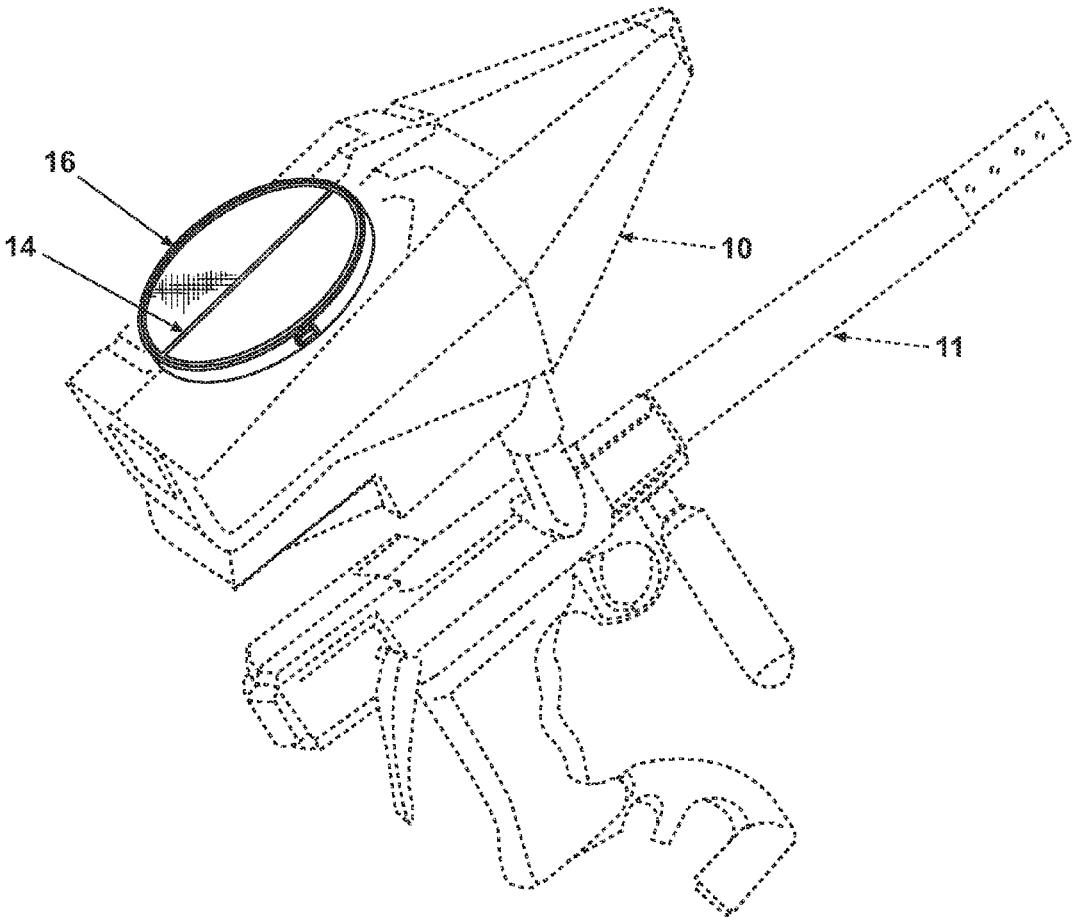
FIG. 27 is a perspective view of a paintball gun attached to a paintball gun storage reservoir provided with a third embodiment of a filling port cover assembly according to the invention.

Referring to FIG. 27, the self-closing cover assembly 16 comprises a pair of plate-like semicircular flaps 18 positioned in planar juxtaposition along a common diameter to form a circular cover having a filling slit 20 extending diametrically therethrough. Preferably, the flaps 18 comprise a fabric having a combination of stiffness and elasticity to enable the flaps 18 to be stretched over the filling port 14 to prevent spillage of paintballs from the reservoir 10 while enabling separation of the flaps 18 and filling of the reservoir 10, as hereinafter described.

Figure 28:
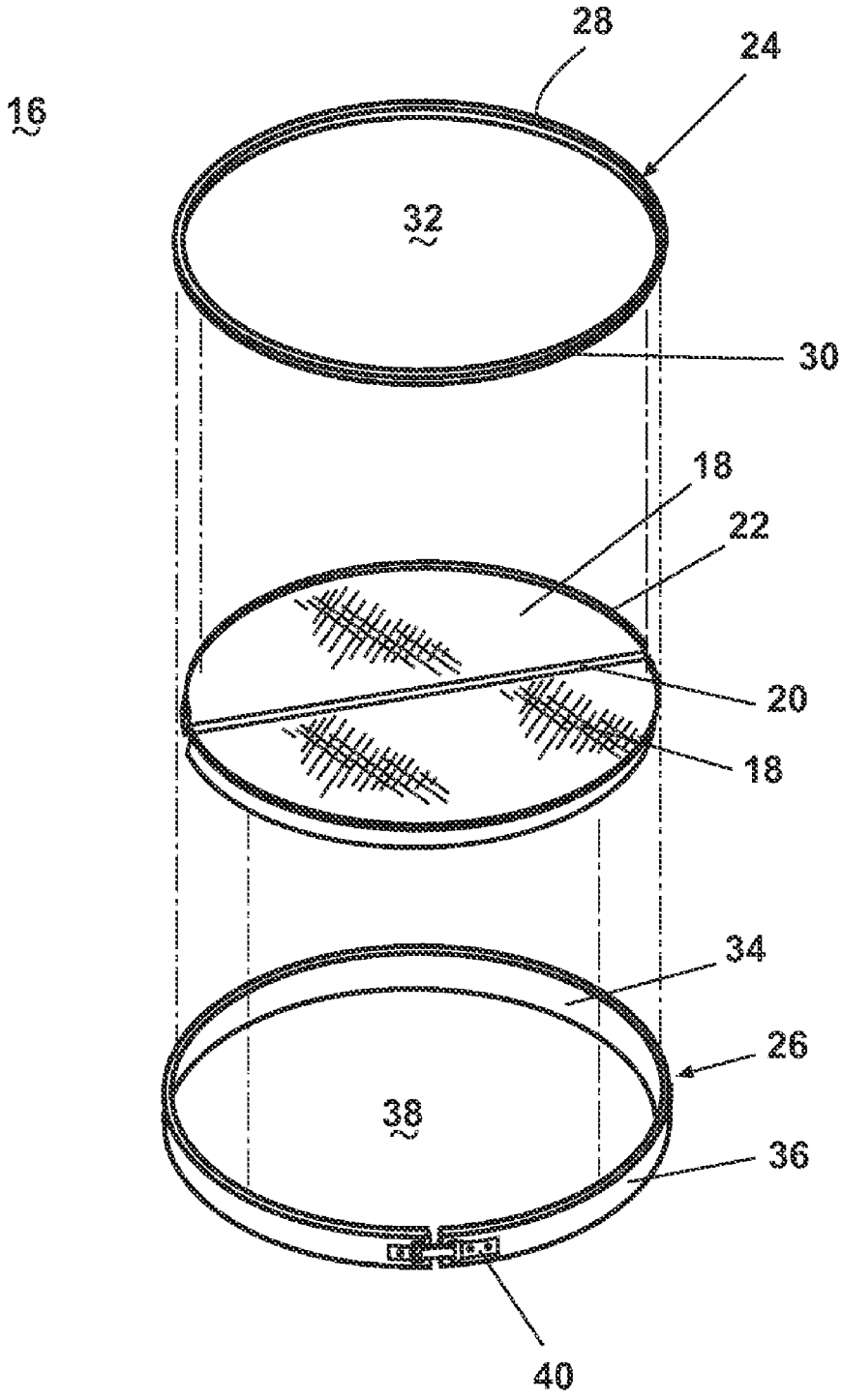
FIG. 28 is an exploded view of the filling port cover assembly illustrated in FIG. 27.
Figure 29:
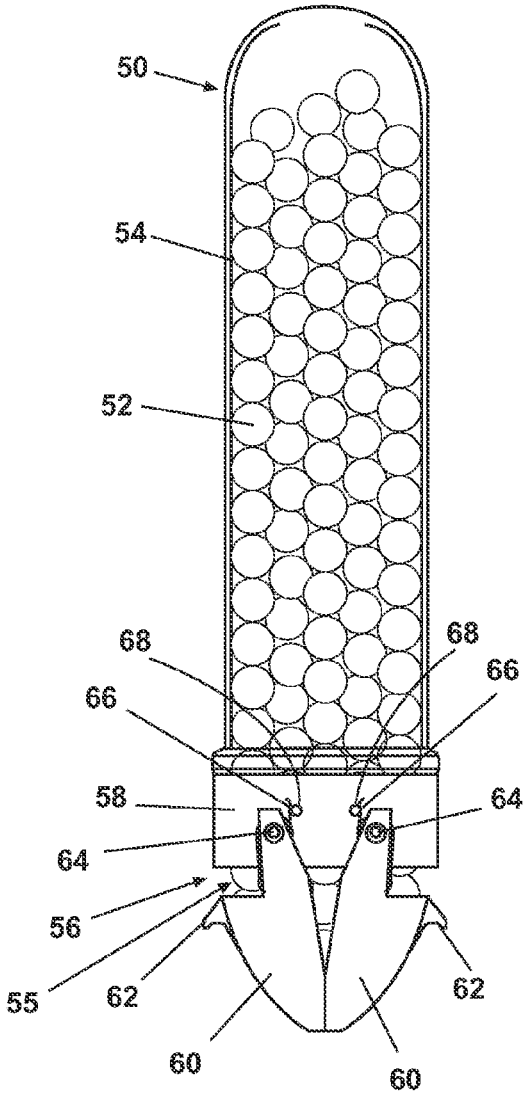
FIG. 29 is a side elevation view of a third embodiment of a paintball gun reloading canister according to the invention in a closed configuration adapted for use with the filling port cover assembly shown in FIG. 27.
Figure 30:
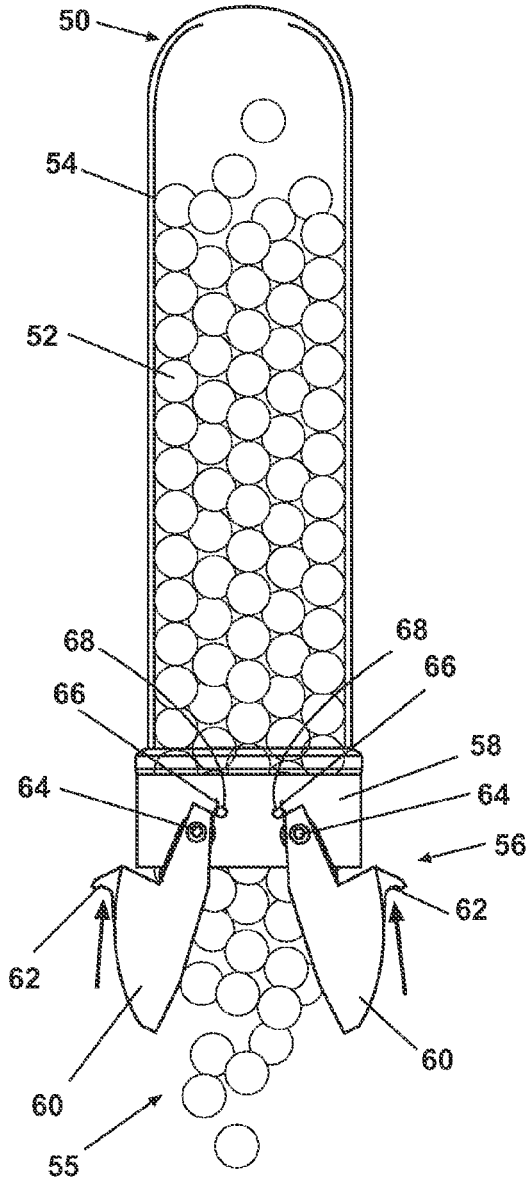
FIG. 30 is a side elevation view of the paintball gun-reloading canister illustrated in FIG. 29 in an open configuration for dispensing of paintballs.

As illustrated in FIG. 28, the cover assembly 16 comprises the flaps 18, an inner ring 24, and an outer ring 26. The inner ring 24 is a circular ring-shaped body comprising an inner face 28 and an outer face 30, and defining a circular opening 32 therethrough. The outer ring 26 is a circular ring-shaped body comprising an inner face 34 and an outer face 36, and a defining a circular opening 38 conveyor through. The outer ring 26 is split axially to enable opening of the ring 26, and is provided with a suitable conventional clamp mechanism 40 across the split for securing the outer ring 26 in a closed position. Alternatively, a conventional band clamp (not shown) can be installed around of the outer ring 26 to urge the outer ring 26 to a closed position. The diameter of the outer ring 26 is somewhat larger than the diameter of the inner ring 24 so that the inner ring 24 can be clamped within the outer ring 26 when the clamp mechanism 40 is tightened to close the outer ring 26.

The flaps 18 terminate along their arcuate edges in a circumferential wall 22 extending orthogonally from the flap 18. The circumferential wall 22 is adapted to be held between the outer face 30 of the inner ring 24 and the inner face 34 of the outer ring 26 when the outer ring 26 is clamped around of the inner ring 24. The resulting drum-like assembly provides a cover having sufficient resistance to opening to prevent spillage of the paintballs from the storage reservoir 10 but sufficient elasticity so that the flaps 18 can be separated along the filling slit 20 thereby enabling the reservoir 10 to be filled.

Figure 31:
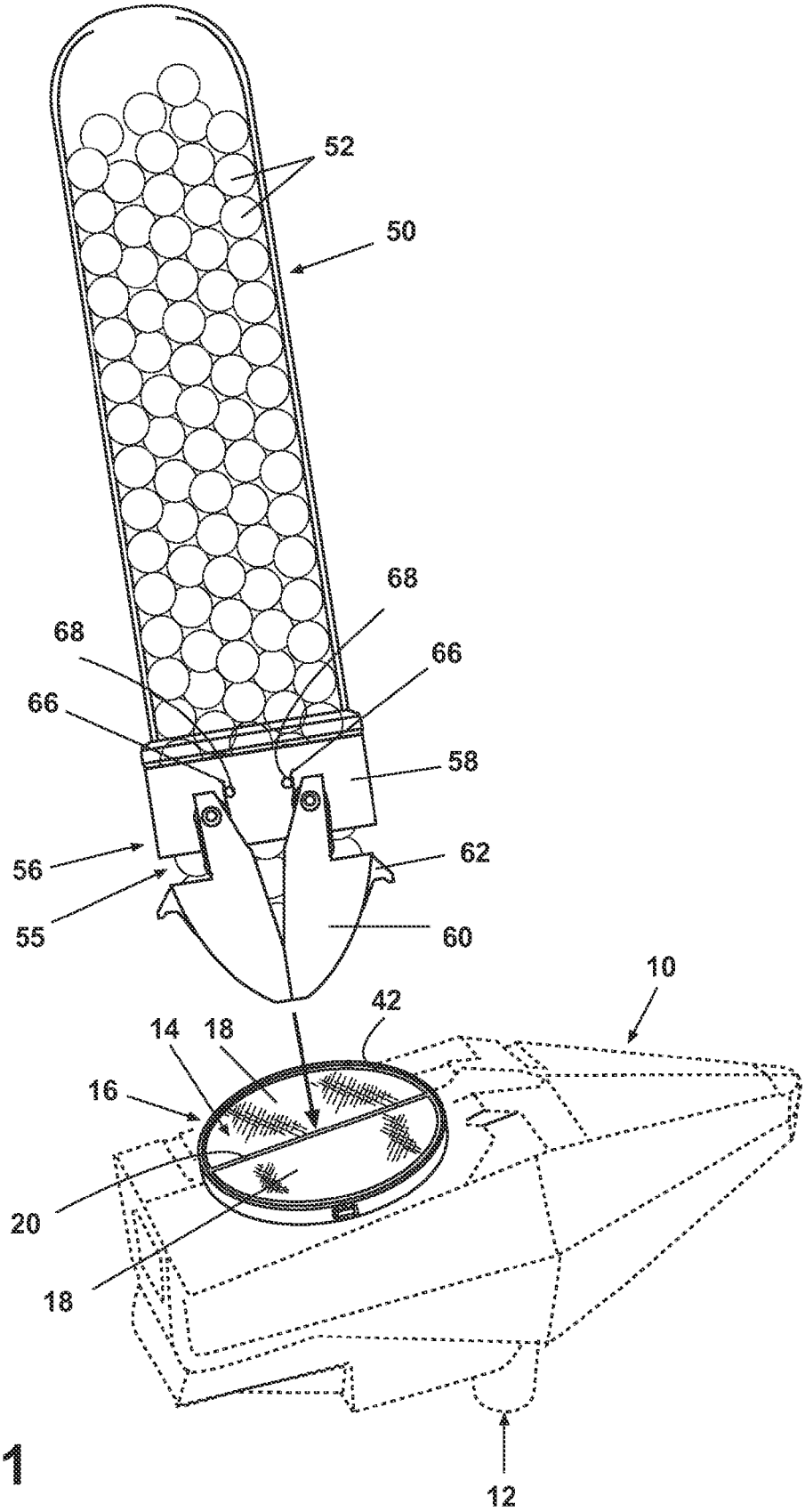
FIG. 31 is a perspective view of the paintball gun reloading canister shown in FIG. 29 being inserted through the filling port cover assembly shown in FIG. 26 to discharge paintballs into the storage reservoir.
Figure 32:
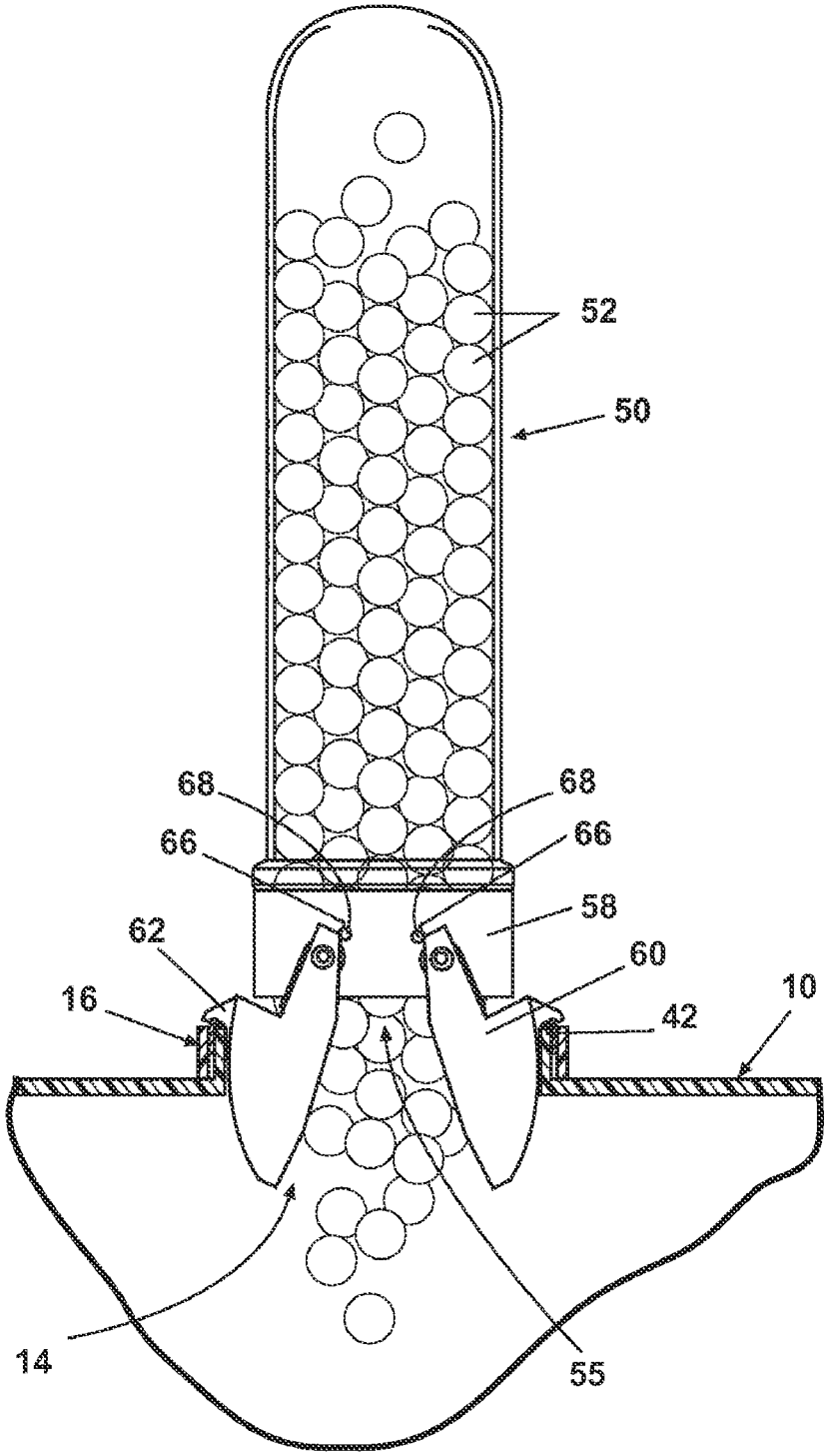
FIG. 32 is a side view of paintballs being discharged from the paintball gun reloading canister shown in FIG. 31 into the storage reservoir.

The cover assembly 16 is attached to the filling port 14 in a suitable manner, such as by clamping the outer ring 26 around the circumference of the filling port 14 using the clamping mechanism 40, or by using conventional fasteners, such as screws, rivets, or adhesives, so that the flaps 18 cover the filling port 14. As shown in FIGS. 27, 31, and 32, the attachment of the cover assembly 16 to the filling port 14 forms a circular bearing rim 42 around the filling port 14, the significance of which will be described hereinafter.

Although the cover assembly 16 has been described and illustrated as retrofit to a reservoir 10 supplied with a stock cover assembly, the cover assembly 16 can be molded or otherwise integrated into the reservoir 10 during the manufacturing process to provide a reservoir with the cover assembly 16 already installed.

FIGS. 29–32 illustrate an alternate embodiment of the paintball gun-reloading canister 50 filled with paintballs 52. The canister 50 comprises a cylindrical reservoir 54 closed at a first end and having a discharge opening 55 at a second end, and a diameter somewhat less than the diameter of the filling port 14. The canister 50 is provided at the second end with a self-closing gate assembly 56 for closing the discharge opening 55 to prevent the paintballs 52 from spilling from the canister 50.

The self-closing gate assembly 56 comprises a hopper assembly having a circular collar 58 adapted for threadably or frictionally removable attachment to the open end 55 of the reservoir 54. Alternatively, the circular collar 58 can be fixedly attached to the open end 55, such as by suitable fasteners, an adhesive, or welding. A pair of cooperatively juxtaposed, somewhat spoon-shaped hopper gates 60 is pivotably attached to the collar 58 to close the open end 55 when the collar 58 is attached to the reservoir 54. A pivot boss 62 extends outwardly from a medial portion of each hopper gate 60, in diametric juxtaposition, preferably at an upper end of the gate 60. A force acting on the pivot boss 62 in the direction of the arrows shown in FIG. 30 will urge the hopper gate 60 to an open position. The collar 58 preferably has a diameter somewhat less than the diameter of the filling port 14 so that the gate assembly 56 can be inserted through the filling port 14, as hereinafter described.

The hopper gates 60 are attached to the collar 58 through a well-known pivot connection 64, and are biased to a closed position by a biasing mechanism, such as the springs 66, in operable communication with the pivot connection 64. As shown in FIGS. 29–32, each spring 66 engages a post 68 extending radially outwardly from the collar 58 to maintain the spring 66 in a condition of tension tending to bias the hopper gates 60 to the closed position. It will be evident to a person having ordinary skill in the art that other biasing mechanisms can be employed to bias the hopper gates 60 to a closed position while enabling the hopper gates 60 to be selectively opened. The pivot connections 64 are positioned adjacent each other near the diametric center of the collar 58 to optimize the leverage of the pivot bosses 62 about the pivot connections 64, thereby optimizing the opening force delivered by the pivot bosses 62 to the hopper gates 60.

As shown in FIGS. 31 and 32, to fill the storage reservoir 10, the canister 50 is inserted into the reservoir 10 so that the hopper gates 60 are inserted through the filling slit 20. As the hopper gates 60 are urged into the filling port 14, the pivot bosses 62 will contact the rim 42 to pivot the hopper gates 60 about the pivot connections 64 to an open position, enabling the paintballs 52 to be discharged into the reservoir 10. If the canister 50 is not completely emptied, the springs 66 will return the hopper gates 60 to the closed position as the hopper gates 60 are removed from the filling port 14, thereby preventing spillage of the paintballs 52. When the canister 50 is removed from the reservoir 10, the flaps 18 will be restored from a distended position under the influence of the hopper gates 60 to a relaxed, planar position covering the filling port 14, thereby preventing the inadvertent spillage of paintballs 52 from the reservoir 10.

Figure 33:
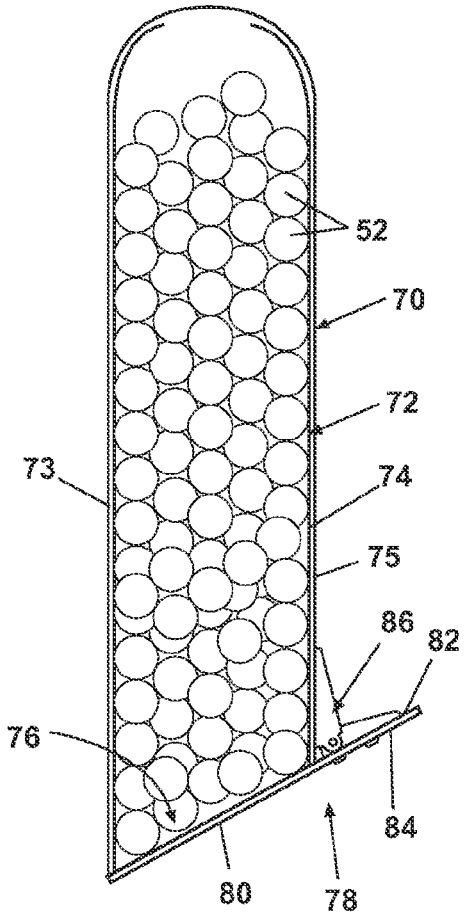
FIG. 33 is a side view of a fourth embodiment of a paintball gun reloading canister in a closed configuration.
Figure 34:
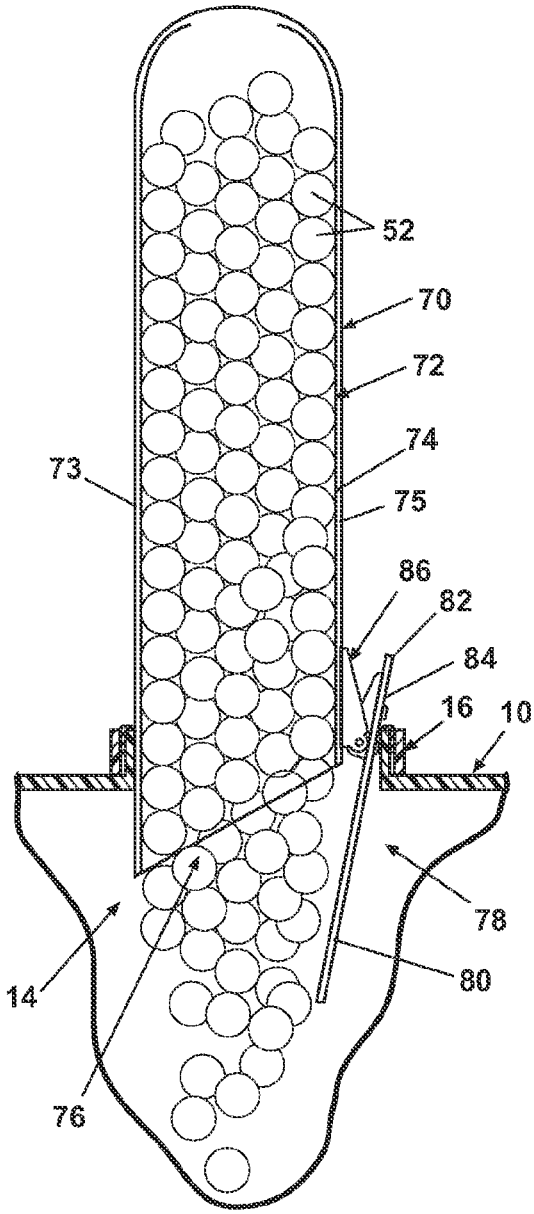
FIG. 34 is a side view of the paintball gun reloading canister of FIG. 33 in an open configuration.
Figure 35:
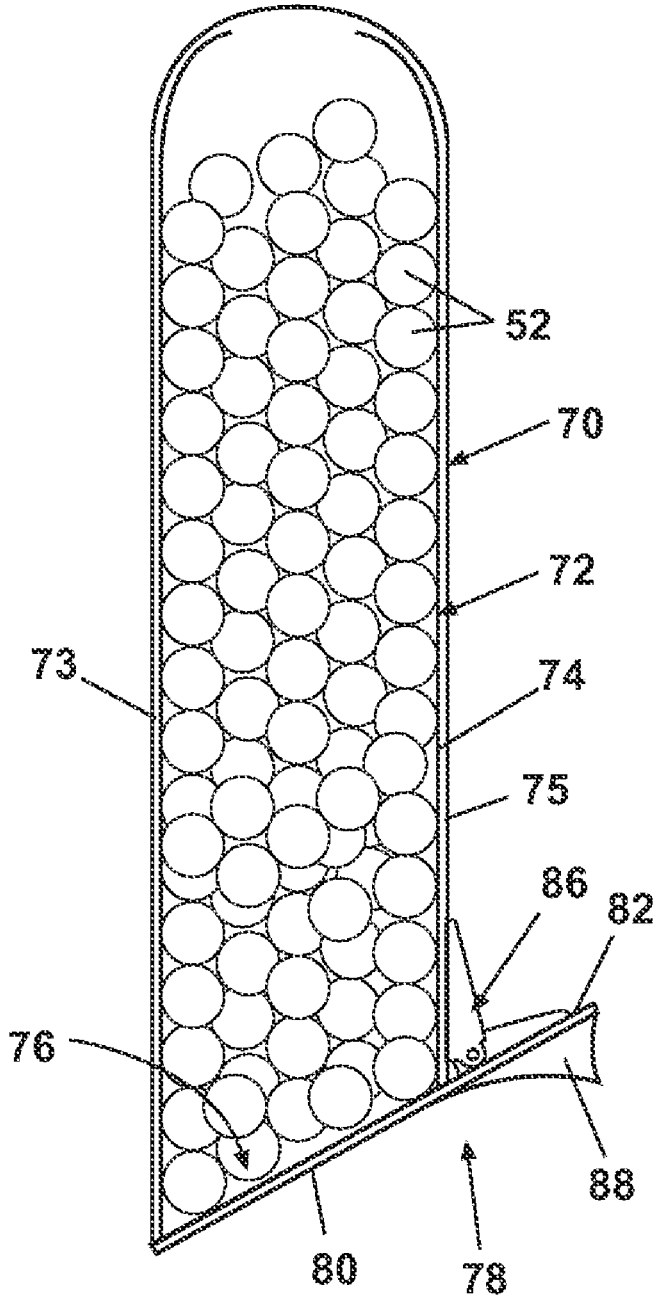
FIG. 35 is a side view of a fifth embodiment of the paintball gun reloading canister in a closed configuration.

FIGS. 33–35 illustrate an alternate embodiment of the reloading canister 70 which is similar in many respects to the canister 50. The canister 70 comprises a cylindrical reservoir 72 comprising a curved wall 74 closed at a first end and having an opening 76 at a second end, and having a diameter somewhat less than the diameter of the filling port 14 to enable the canister 70 to be inserted through the filling port 14. The opening 76 is inclined relative to a longitudinal axis of the canister 70, and thus defines a long wall line 73 and a short wall line 75 in parallel, diametric juxtaposition, parallel to a longitudinal axis of the canister 70.

A gate assembly 78 closes the opening 76, and comprises a plate-like gate 80 and a hinge 86 pivotably attaching the gate 80 to the wall 74 adjacent the opening 76. The gate 80 is provided with a coplanar gate arm 82 extending away from the wall 74, and having a contact surface 84. The hinge 86 is mounted to the wall 74 and the gate arm 82 to enable the gate 80 to pivot between an open position and a closed position, as shown in FIGS. 33 and 34. Preferably, the hinge 86 is spring-biased to an open position to maintain the gate 80 in a closed position over the opening 76. The hinge 86 is fixedly mounted to the wall 74 at the intersection of the short wall line 75 with the opening 76, and fixedly attached to the gate arm 82 to enable the gate 80 to completely close the opening 76.

As shown in FIG. 34, as the reloading canister 70 is inserted through the filling port 14, the gate arm 82 will engage the rim 42, which will exert a force against the contact surface 84 tending to pivot the gate 80 to an open position. The paintballs 52 will then be discharged through the opening 76 to fill the storage reservoir 10. As the canister 70 is removed from the storage reservoir 10, the gate 80 will return to a closed position over the opening 76, thereby preventing any paintballs 52 remaining in the canister 70 from being inadvertently spilled from the canister 70. As shown in FIG. 35, the gate arm 82 can be provided with a contact boss 88 extending away from the contact surface 84 and adapted to engage the rim 42 to provide enhanced opening leverage to the gate arm 82 as the canister 70 is inserted through the filling port 14.

The paintball gun reloading system described herein can be readily adapted for use with paintball gun reservoirs having different configuration. The paintball gun reloading system comprises few moving parts, thereby reducing the potential for equipment malfunctioning, and maximizing the efficiency and reliability of filling operations. The above-described filling operations can be completed with one hand, thereby enabling the continued handling and firing of the paintball gun with a player's firing hand. A full canister can be removed from a pack or other carrying device during a game, both the canister and the reservoir can be opened in a single movement, and the canister can be emptied of its supply of paintballs into the reservoir while the paintball gun continues to be fired. If the canister is not fully emptied, the gate assembly can be readily reclosed at the canister returned to the player's pack for later use in filling the reservoir, thereby reducing loss and waste of paintballs.

While the invention has been specifically described in connection with certain specific embodiments thereof, it is to be understood that this is by way of illustration and not of limitation. Reasonable variation and modification are possible within the scope of the foregoing description and drawings without departing from the spirit of the invention.

The invention claimed is:

1. A paintball gun reloading assembly for use by a participant in a paintball competition to supply paintballs to a paintball storage reservoir having a filling opening therein, the paintball gun reloading assembly comprising:

a cover assembly attached to the paintball storage reservoir over the filling opening, and comprising at least one movable cover;

a reloading canister having a discharge opening adapted for at least partial insertion beyond the at least one cover into the filling opening, and comprising a gate assembly having at least one gate; and at least one pivot boss attached to the at least one gate for opening the at least one gate when the at least one pivot boss is brought into contact with the cover assembly by the insertion of the discharge opening into the filling opening.

2. A paintball gun reloading assembly according to claim 1, wherein the cover assembly comprises a hinged cover.

3. A paintball gun reloading assembly according to claim 2, wherein the hinged cover further comprises a flange portion for engaging the at least one pivot boss.

4. A paintball gun reloading assembly according to claim 3, and further comprising a movable latch pin attached to the at least one pivot boss.

5. A paintball gun reloading assembly according to claim 3, wherein the cover assembly comprises a tongue piece for directing the pivot boss to the flange portion.

6. A paintball gun reloading assembly according to claim 1, wherein the cover assembly comprises a tongue piece for directing the discharge opening to one of the hinged cover and the filling opening.

7. A paintball gun reloading assembly according to claim 1, and further comprising a biasing mechanism for urging the cover to a closed position.

8. A paintball gun reloading assembly according to claim 1, wherein the at least one pivot boss is attached to the at least one gate.

9. A paintball gun reloading assembly according to claim 1, and further comprising a biasing mechanism for urging the at least one gate to the closed position.

10. A paintball gun reloading assembly for use by a participant in a paintball competition to supply paintballs to a paintball storage reservoir having a filling opening therein, the paintball gun reloading assembly comprising:

a cover assembly attached to the paintball storage reservoir comprising a movable cover having a flange portion;

a reloading canister having a discharge opening adapted for at least partial insertion into the filling opening and comprising a gate assembly having at least one gate; and at least one pivot boss attached to the at least one gate for moving the at least one gate and opening the movable cover when the at least one pivot boss is in contact with the flange portion and the reloading canister is moved into the filling opening;

wherein the cover and the at least one gate are movable to an open position by the engagement of the reloading canister with the cover assembly, and wherein the participant can continuously operate the paintball gun during the filling process.

11. A paintball gun reloading assembly according to claim 10, wherein the cover assembly comprises a hinged cover.

12. A paintball gun reloading assembly according to claim 10, and further comprising a movable latch pin attached to the at least one pivot boss.

13. A paintball gun reloading assembly according to claim 10, wherein the cover assembly comprises a tongue piece for directing the discharge opening to one of the hinged cover and the filling opening.

14. A paintball gun reloading assembly according to claim 10, wherein the cover assembly comprises a tongue piece for directing the pivot boss to the flange portion.

15. A paintball gun reloading assembly according to claim 10, and further comprising a biasing mechanism for urging the cover to the closed position.

16. A paintball gun reloading assembly according to claim 15, wherein the biasing mechanism is a spring.

17. A paintball gun reloading assembly according to claim 10, wherein the at least one pivot boss is attached to the at least one gate.

18. A paintball gun reloading assembly according to claim 10, and further comprising a biasing mechanism for urging the at least one gate to the closed position.

19. A paintball gun reloading assembly according to claim 18, wherein the biasing mechanism is a spring.

20. A paintball gun reloading assembly for use by a participant in a paintball competition to supply paintballs to a paintball storage reservoir having a filling opening therein, the paintball gun reloading assembly comprising:

a cover assembly attached to the paintball storage reservoir comprising a movable cover;

a reloading canister having a discharge opening adapted for at least partial insertion into the filling opening and comprising a gate assembly having at least one elliptical gate; and at least one pivot boss attached to the at least one gate for moving the at least one gate when the at least one pivot boss is in contact with the cover assembly and the reloading canister is moved into the filling opening;

wherein the cover and the at least one gate are movable to an open position by the engagement of the reloading canister with the cover assembly, and wherein the participant can continuously operate the paintball gun during the filling process.

21. A combination paintball gun, paintball storage reservoir, and paintball gun reloading assembly, comprising:

a paintball gun for use by a participant in a paintball competition for firing paintballs at a target;

a paintball storage reservoir having a filling opening therein and attached to the paintball gun for supplying paintballs to the paintball gun;

a cover assembly attached to the paintball storage reservoir comprising a movable cover having a flange portion;

a reloading canister having a discharge opening adapted for at least partial insertion into the filling opening and comprising a gate assembly having at least one gate; and a pivot boss for moving the at least one gate and opening the movable cover when the pivot boss is in contact with the flange portion and the reloading canister is moved relative to the filling opening;

wherein the cover and the at least one gate are movable to an open position by the engagement of the reloading canister with the cover assembly, and wherein the participant can continuously operate the paintball gun during the filling process.

22. A combination according to claim 21, wherein the cover assembly comprises a hinged cover.

23. A combination according to claim 21, and further comprising a movable latch pin attached to the at least one pivot boss.

24. A combination according to claim 21, wherein the cover assembly comprises a tongue piece for directing the discharge opening to one of the hinged cover and the filling opening.

25. A combination according to claim 21, wherein the cover assembly comprises a tongue piece for directing the pivot boss to the flange portion.

26. A combination according to claim 21, and further comprising a biasing mechanism for urging the cover to the closed position.

27. A combination according to claim 26, wherein the biasing mechanism is a spring.

28. A combination according to claim 21, wherein the at least one pivot boss is attached to the at least one gate.

29. A combination according to claim 21, and further comprising a biasing mechanism for urging the at least one gate to the closed position.

30. A combination according to claim 29, wherein the biasing mechanism is a spring.

31. A method for supplying paintballs to a paintball storage reservoir having a filling opening therein, the method comprising:

attaching a cover assembly comprising at least one cover over the filling opening of the paintball storage reservoir;

engaging a reloading canister comprising a discharge opening and at least one gate with the filling opening by at least partially inserting the discharge opening beyond the at least one cover into the filling opening;

opening the at least one cover as the discharge opening is at least partially inserted beyond the at least one cover into the filling opening; and discharging paintballs through the discharge opening into the filling opening to fill the storage reservoir.

32. A method according to claim 31, and furthermore moving the reloading canister toward the filling opening so that at least one pivot boss extending from the at least one gate is in contact with the cover assembly.

33. A method according to claim 32, and furthermore moving the reloading canister toward the filling opening along a tongue piece.

34. A method according to claim 32, and furthermore moving the reloading canister away from the filling opening to move the cover from an open position to a closed position.

35. A method according to claim 32, and furthermore moving the reloading canister away from the filling opening to move the at least one gate from an open position to a closed position.

36. A method according to claim 32, and furthermore pivoting the at least one gate from a closed position to an open position.

37. A method according to claim 32, and furthermore latching the at least one gate in a closed position with a movable latch pin.

* * * * *